US011821607B2

(12) United States Patent
Cai

(10) Patent No.: US 11,821,607 B2
(45) Date of Patent: Nov. 21, 2023

(54) LIGHTING FIXTURE CONVENIENT TO PACK

(71) Applicant: Yueqi Cai, Ningbo (CN)

(72) Inventor: Yueqi Cai, Ningbo (CN)

( * ) Notice: Subject to any disclaimer, the term of this patent is extended or adjusted under 35 U.S.C. 154(b) by 0 days.

(21) Appl. No.: 17/844,082

(22) Filed: Jun. 20, 2022

(65) Prior Publication Data

US 2022/0316680 A1 Oct. 6, 2022

Related U.S. Application Data

(63) Continuation-in-part of application No. 17/722,415, filed on Apr. 18, 2022, now abandoned.

(51) Int. Cl.
*F21V 1/14* (2006.01)

(52) U.S. Cl.
CPC ..... *F21V 1/14* (2013.01)

(58) Field of Classification Search
CPC ..... F21V 1/14
See application file for complete search history.

(56) References Cited

U.S. PATENT DOCUMENTS

2016/0202825 A1* 7/2016 Tang ..... G06F 1/3206 345/173
2019/0339439 A1 11/2019 Hawthorne et al.
2020/0063954 A9 2/2020 Shi
2020/0355359 A1 11/2020 Pan et al.

* cited by examiner

*Primary Examiner* — Anne M Hines

(57) ABSTRACT

The present invention discloses a lighting fixture convenient to pack and a lighting fixture assembly method. The lighting fixture consists of a lampshade; the lampshade consists of a hood body with a cavity and a frame at the opening edge of the hood body; the cavity of the hood body is used to accommodate the luminous source of the lighting fixture; the hood body consists of multiple oblique outer wall surface, and the cavity of the hood body consists of multiple fourth oblique inner wall surfaces; multiple lighting fixtures are stacked together and arranged externally with the frame; and the stacked lampshades are elevated to reserve certain spacing between the oblique outer wall surfaces. The oblique inner wall surfaces, the oblique outer wall surfaces, and the frame away from the inner cavity are arranged to reach the technical effect of stacking of multiple lampshades.

11 Claims, 26 Drawing Sheets

LIGHTING FIXTURE CONVENIENT TO PACK

TECHNICAL FIELD

The present invention relates to the field of the invention of a lighting fixture and lighting fixture assembly, particularly to a lighting fixture convenient to pack and a lighting fixture assembly method.

BACKGROUND

Lighting fixture is a necessary appliance mainly used for home lighting and public lighting. Generally, in order to improve the lighting effect and illumination area effect, the volume of the lighting fixture will be increased. In the prior art, during the packaging, a single lighting fixture is packaged by a box body. Therefore, when there are a large number of lighting fixtures, since each lighting fixture requires a box body, the packaging cost will be high. In addition, the volume of the lighting fixture after the packaging is rather large and the number of the lighting fixtures that can be transported by each vehicle for each transportation is limited, multiple vehicles will be required for each transportation, resulting in high transportation cost.

SUMMARY

The present invention is to design a lighting fixture convenient to pack and a lighting fixture assembly method, and the specific method is as follows.

The present invention relates to a lighting fixture convenient to pack, which consists of a lampshade; the lampshade consists of a hood body with a cavity and a frame at the opening edge of the hood body; the cavity of the hood body is used to accommodate the luminous source of the lighting fixture;

The hood body consists of the first oblique outer wall surface, the second oblique outer wall surface, the third oblique outer wall surface, and the fourth oblique outer wall surface; the cavity of the hood body consists of the first oblique inner wall surface corresponding to the first oblique outer wall surface, the second oblique inner wall surface corresponding to the second oblique outer wall surface, the third oblique inner wall surface corresponding to the third oblique outer wall surface, and the fourth oblique inner wall surface corresponding to the fourth oblique outer wall surface; the first oblique outer wall surface and the second oblique outer wall surface are arranged opposite to each other, while the third oblique outer wall surface and the fourth oblique outer wall surface are arranged opposite to each other; the first oblique inner wall surface and the second oblique inner wall surface are arranged opposite to each other, while the third oblique inner wall surface and the fourth oblique inner wall surface are arranged opposite to each other.

Preferably, the lampshade also consists of a bulge part on the hood body, the bulge part consists of a concave cavity connected with the cavity, and the luminous source of the lighting fixture is placed in the concave cavity.

Preferably, the first edging and the second edging arranged opposite to each other in the frame are respectively equipped with the supports; and the supports consist of the supporting planes.

Preferably, an actuator is arranged obliquely; the actuator is arranged on the side of the hood body that is away from the second oblique outer wall surface and on the first oblique outer wall surface; and the angle of inclination of the actuator is the same as the angle with the first oblique outer wall surface.

Preferably, the first convex part is formed on the side of the bulge part that is away from the second oblique outer wall surface; and the oblique supporting surface of the first convex part fits the inclined plane of the actuator.

Preferably, the concave cavity consists of the fifth oblique inner wall surface, the sixth oblique inner wall surface, the first V-shaped concave, and the second V-shaped concave; the fifth oblique inner wall surface and the sixth oblique inner wall surface are arranged opposite to each other; the first V-shaped concave and the second V-shaped concave are arranged opposite to each other; and the included angle between the fifth oblique inner wall surface/the sixth oblique inner wall surface and the horizontal inner wall surface in the concave cavity is an obtuse angle.

Preferably, the included angle between the first oblique outer wall surface/the second oblique outer wall surface and the horizontal outer wall surface of the bulge part is a, while the included angle between the third oblique outer wall surface/the fourth oblique outer wall surface and the horizontal outer wall surface of the bulge part is b; a is an obtuse angle, and b is a reflex angle, so a is smaller than b ($a<b$);

The included angle between the first oblique inner wall surface/the second oblique inner wall surface and the horizontal inner wall surface of the bulge part is c, while the included angle between the third oblique inner wall surface/the fourth oblique inner wall surface and the horizontal inner wall surface of the bulge part is d; a is an obtuse angle, and b is a reflex angle, so c is smaller than d ($c<d$).

Preferably, the lampshade also consists of an elongated plate and the first oblique side plate and the second oblique side plate located at the edges of two opposite sides of the elongated plate; the elongated plate is bent to form the second convex part located in the middle and with a channel, the first oblique piece and the second oblique piece located on two opposite sides of the second convex part; the first edging and the support on the first edging are formed at the side edge of the first oblique piece, while the second edging and the support on the second edging are formed at the side edge of the second oblique piece; the first convex piece and the third edging are formed on the first oblique side plate, while the second convex piece and the fourth edging are formed on the second oblique side plate; the first edging, the second edging, the third edging, and the fourth edging are connected end to end to form the frame; one port of the second convex part fits the first convex piece to close one end of the channel, and the other port of the second convex part fits the second convex piece to close the other end of the channel, thus forming the bulge part and the concave cavity in the bulge part; one end of the first oblique piece and one end of the second oblique piece fit the first oblique side plate, and the other end of the first oblique piece and the other end of the second oblique piece fit the second oblique side plate; the first oblique outer wall surface is formed on the outer wall of the first oblique piece, the second oblique outer wall surface is formed on the outer wall of the first oblique piece, and the third oblique outer wall surface is formed on the outer wall of the first oblique side plate, and the fourth oblique outer wall surface is formed on the outer wall of the second oblique side plate; the first oblique inner wall surface is formed on the inner wall of the first oblique piece, the second oblique inner wall surface is formed on the inner wall of the first oblique piece, the third oblique inner wall surface is formed on the inner wall of the first oblique side plate, and the fourth oblique inner wall surface is formed on the inner wall of the second oblique side plate.

Preferably, at least one of the inner wall of the first oblique side plate facing the first oblique piece, the inner wall of the first oblique side plate facing the second oblique piece, the inner wall of the second oblique side plate facing the first oblique piece, and the inner wall of the second oblique side plate facing the second oblique piece has a storage groove for the storage of cables.

Preferably, the included angle between the first oblique outer wall surface/the second oblique outer wall surface and the horizontal outer wall surface of the bulge part is a, while the included angle between the third oblique outer wall surface/the fourth oblique outer wall surface and the horizontal outer wall surface of the bulge part is b; a is an obtuse angle, and b is a reflex angle, so a is smaller than b (a<b);

The included angle between the first oblique inner wall surface/the second oblique inner wall surface and the horizontal inner wall surface of the bulge part is c, while the included angle between the third oblique inner wall surface/the fourth oblique inner wall surface and the horizontal inner wall surface of the bulge part is d; a is an obtuse angle, and b is a reflex angle, so c is smaller than d (c<d).

Preferably, the lampshade also consists of an elongated plate and the first oblique side plate and the second oblique side plate located at the edges of two opposite sides of the elongated plate; the elongated plate is bent to form the second convex part located in the middle and with a channel, the first oblique piece and the second oblique piece located on two opposite sides of the second convex part; the first edging and the support on the first edging are formed at the side edge of the first oblique piece, while the second edging and the support on the second edging are formed at the side edge of the second oblique piece; the first convex piece and the third edging are formed on the first oblique side plate, while the second convex piece and the fourth edging are formed on the second oblique side plate; the first edging, the second edging, the third edging, and the fourth edging are connected end to end to form the frame; one port of the second convex part fits the first convex piece to close one end of the channel, and the other port of the second convex part fits the second convex piece to close the other end of the channel, thus forming the bulge part and the concave cavity in the bulge part; one end of the first oblique piece and one end of the second oblique piece fit the first oblique side plate, and the other end of the first oblique piece and the other end of the second oblique piece fit the second oblique side plate; the first oblique outer wall surface is formed on the outer wall of the first oblique piece, the second oblique outer wall surface is formed on the outer wall of the first oblique piece, and the third oblique outer wall surface is formed on the outer wall of the first oblique side plate, and the fourth oblique outer wall surface is formed on the outer wall of the second oblique side plate; the first oblique inner wall surface is formed on the inner wall of the first oblique piece, the second oblique inner wall surface is formed on the inner wall of the first oblique piece, the third oblique inner wall surface is formed on the inner wall of the first oblique side plate, and the fourth oblique inner wall surface is formed on the inner wall of the second oblique side plate.

Preferably, the locating pieces are formed on the inner wall of the first oblique side plate facing the first oblique piece, the inner wall of the first oblique side plate facing the second oblique piece, the inner wall of the second oblique side plate facing the first oblique piece, the inner wall of the second oblique side plate facing the second oblique piece, the convex piece inner wall of the first oblique side plate, and the convex piece inner wall of the second oblique side plate; and the locating pieces fit the outer wall of the first oblique piece, the outer wall of the second oblique piece, and the horizontal outer wall surface respectively.

The present invention relates to a lighting fixture convenient to pack. The oblique inner wall surfaces, the oblique outer wall surfaces, and the frame away from the inner cavity are arranged to realize the stacking of multiple lampshades. In addition, after the stacking, for two adjacent lampshades, one lampshade is placed on the other lampshade, the hood body of one lampshade is placed in the inner cavity of the other lampshade, the frame of one lampshade fits the frame of the other lampshade, each oblique outer wall surface of one lampshade have certain spacing with each oblique inner wall surface of the other lampshade, and the horizontal outer wall surface of one lampshade has certain spacing with the horizontal inner wall surface of the other lampshade. The spacing after stacking is to prevent the friction between the outer wall of the lampshade and the inner wall of the lampshade and avoid any scratches on the outer wall of the lampshade. In addition, multiple lampshades are stacked for the packaging of multiple lighting fixtures each time, thus reducing the packaging cost and transportation cost.

DETAILED DESCRIPTION

Technical solutions in embodiments of the present invention will be clearly and completely described with reference to the drawings in the embodiments of the present invention. Apparently, the embodiments described below are merely part, not all, of the embodiments of the present invention. Based on the embodiments described in the present invention, all other embodiments obtained by those of ordinary skill in the art are within the scope of the present invention.

Embodiment I

Figure 1:
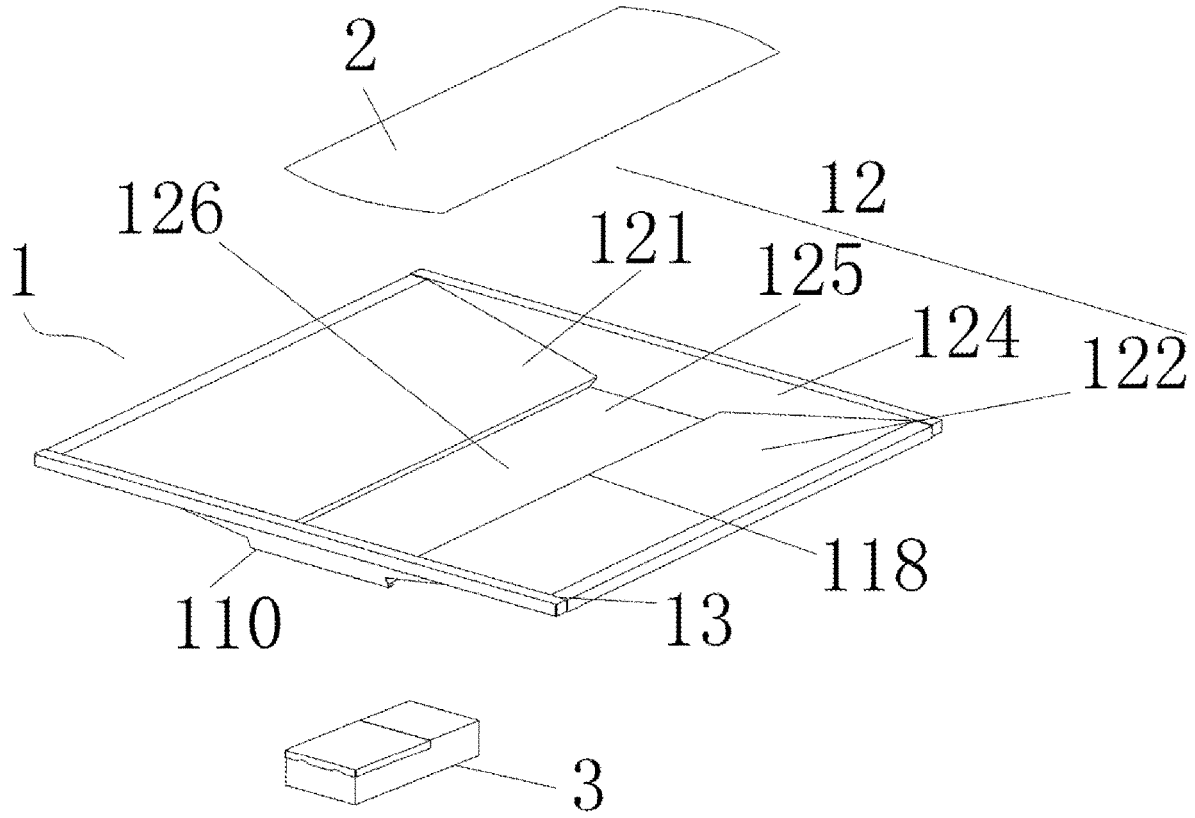
FIG. 1 is an exploded view of the lighting fixture.
Figure 2:
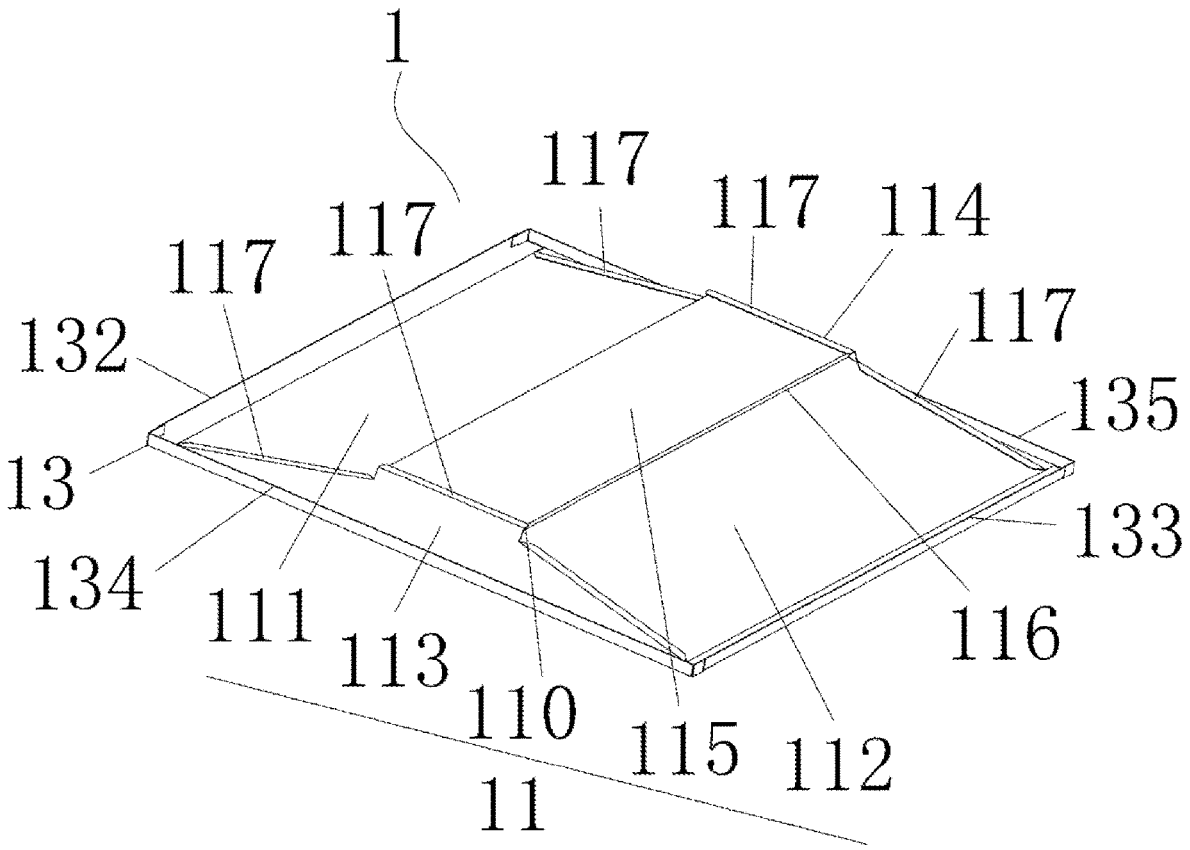
FIG. 2 is a structural schematic view of the lampshade (1)
Figure 3:
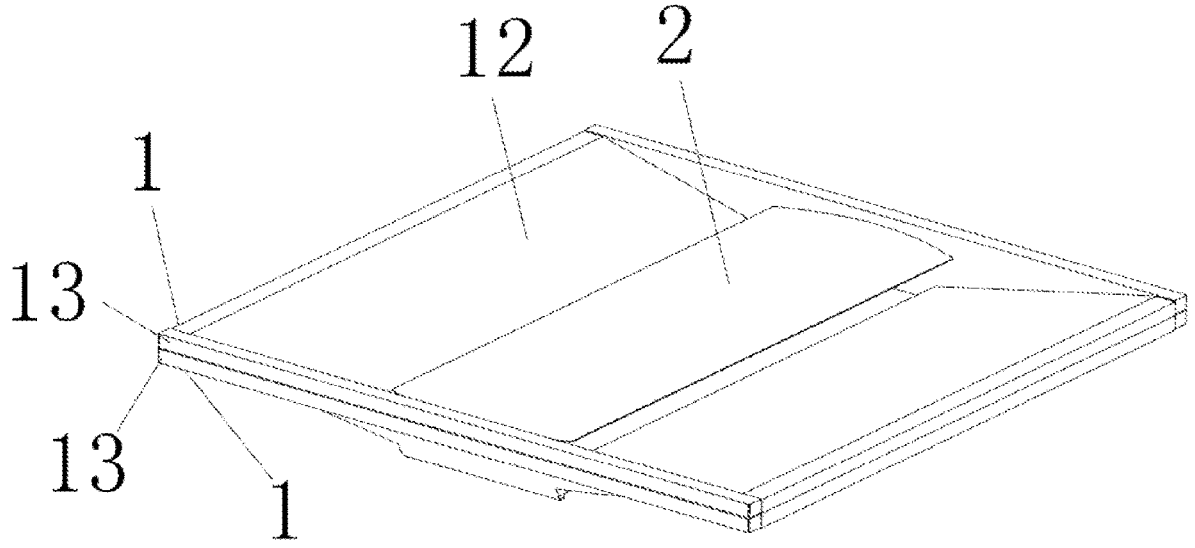
FIG. 3 is a structural schematic view of the stacking of two lampshades (1)
Figure 4:
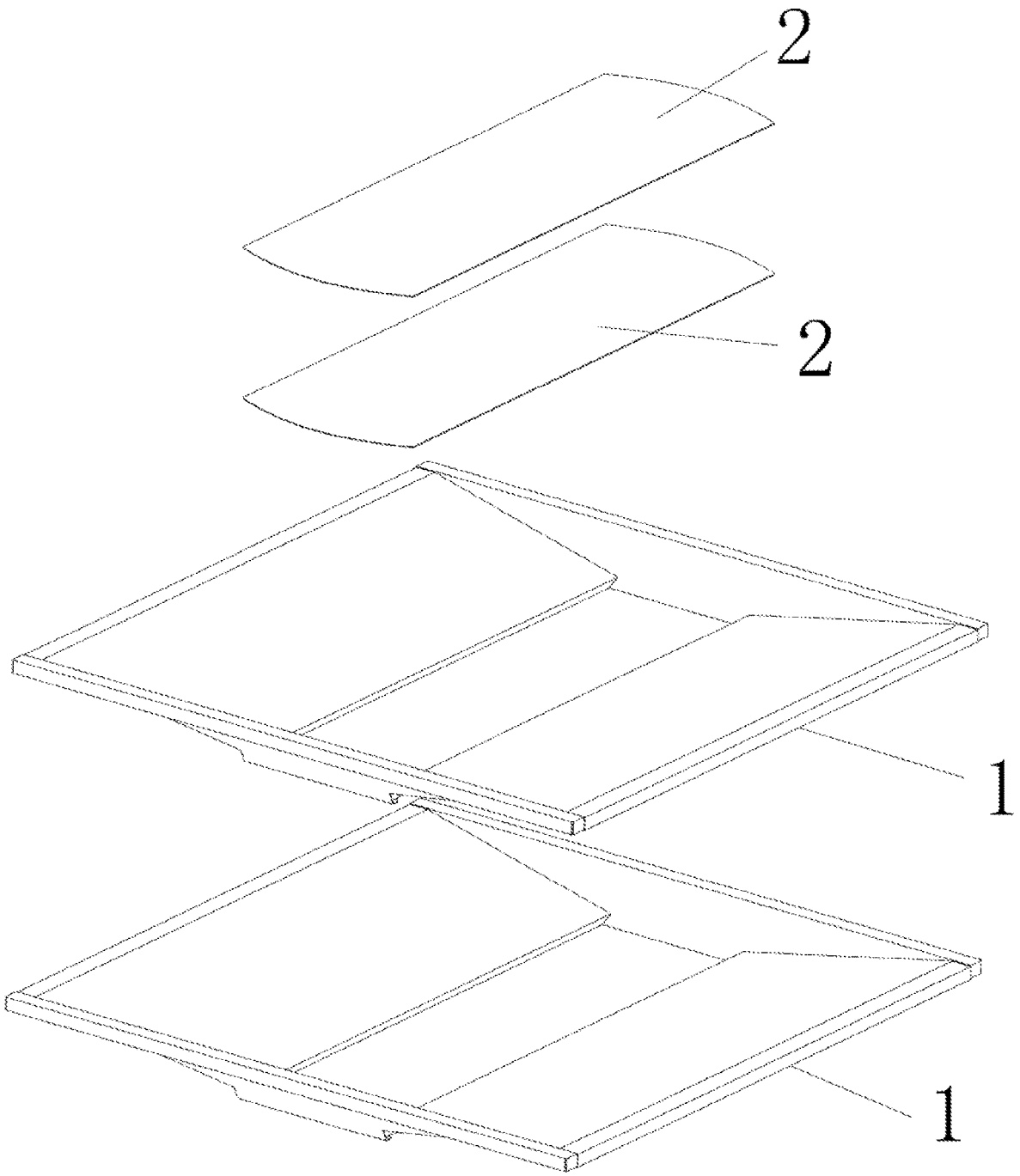
FIG. 4 is an exploded view (I) of two lampshades (1)
Figure 5:
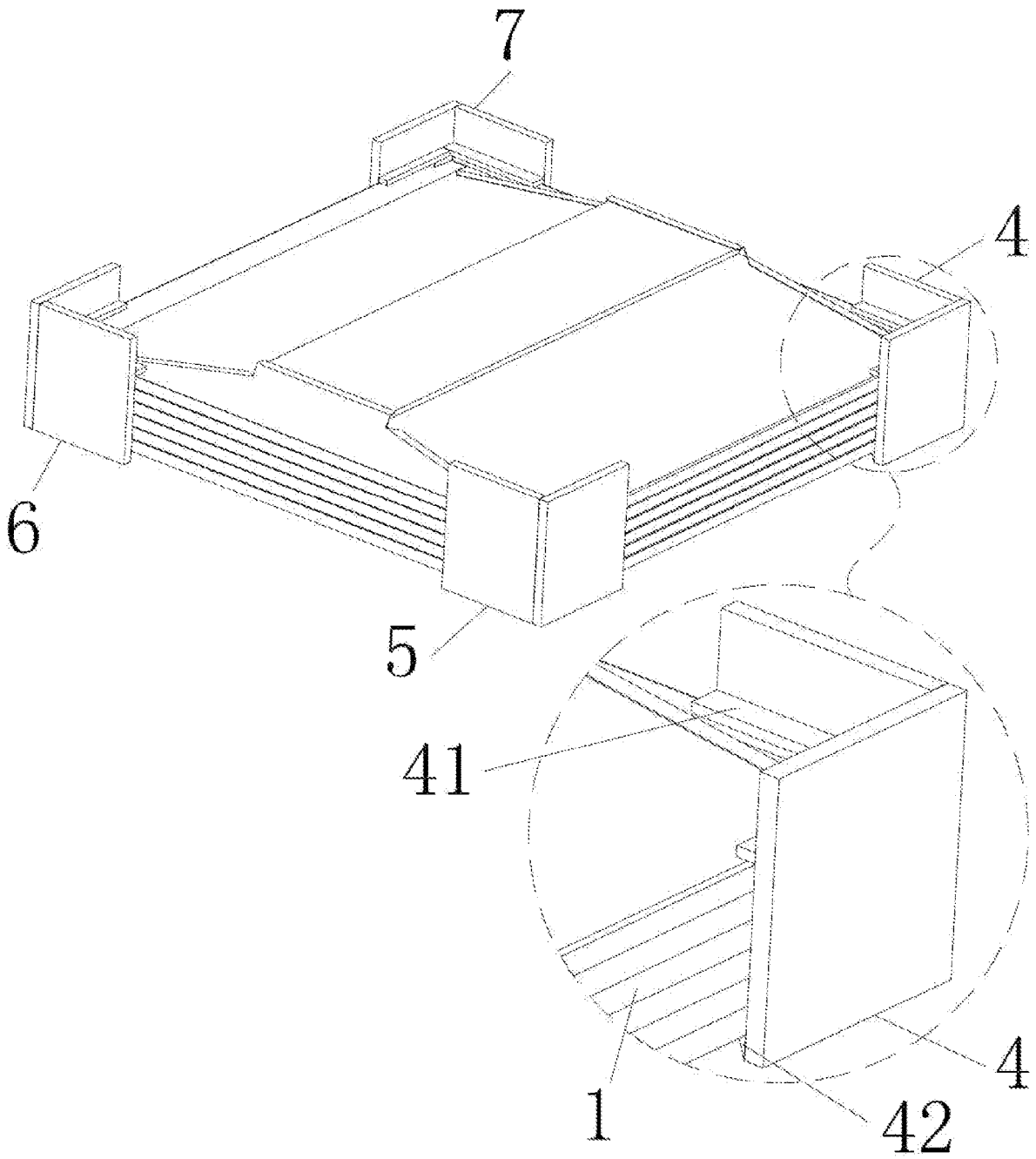
FIG. 5 is a structural schematic view of the corners sleeved with protective shells of the stacked body.
Figure 6:
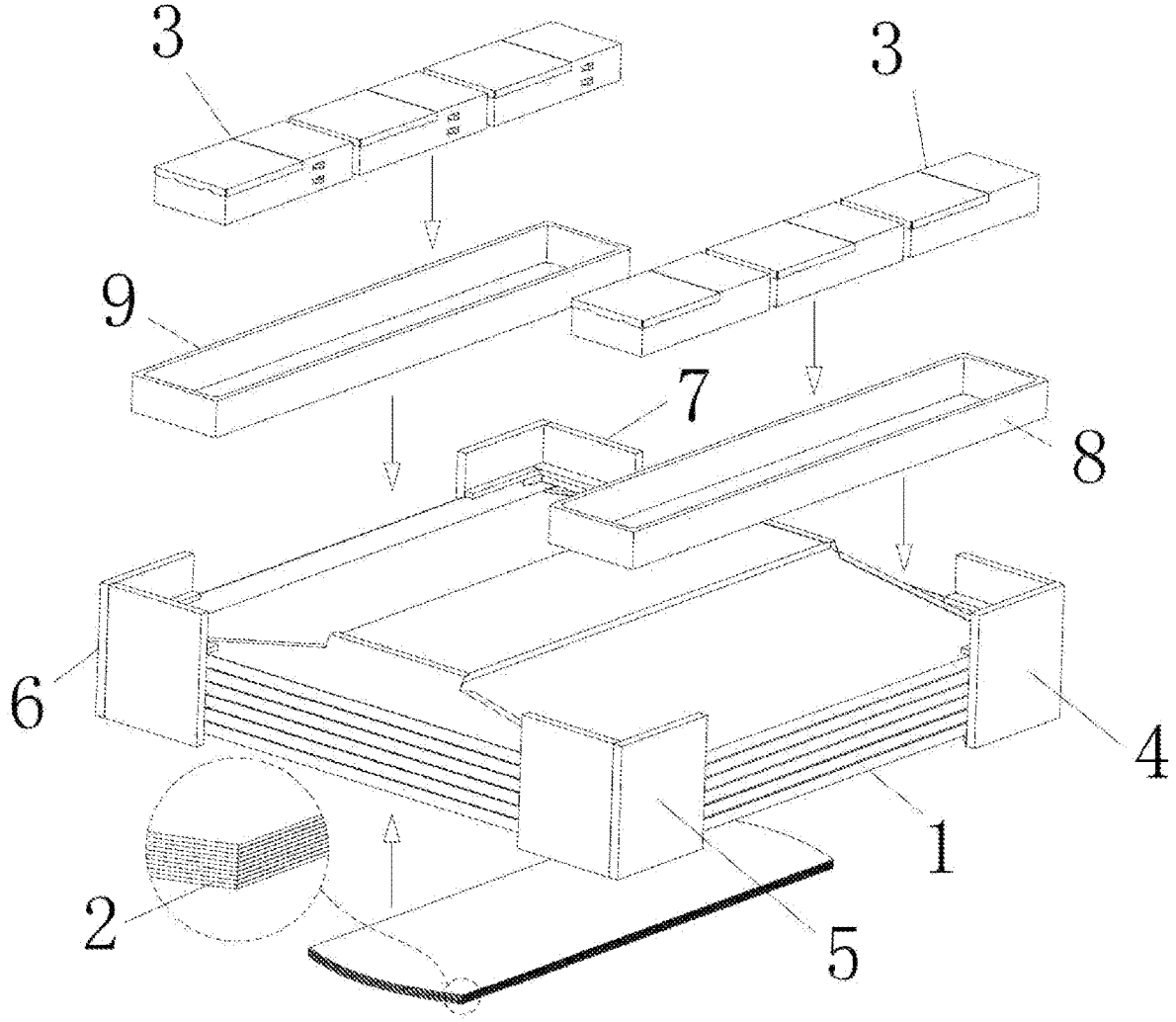
FIG. 6 is a schematic view of the stacking sequence of packaging assembly.
Figure 7:
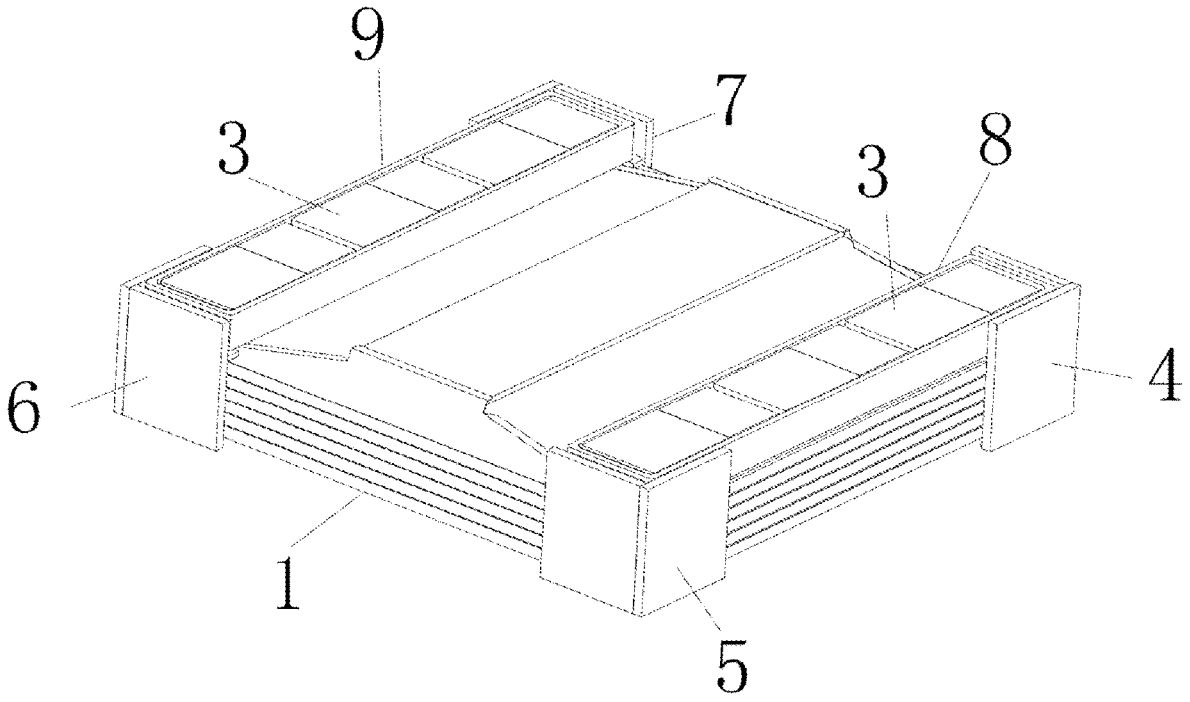
FIG. 7 is a structural schematic view of the packaging assembly.
Figure 8:
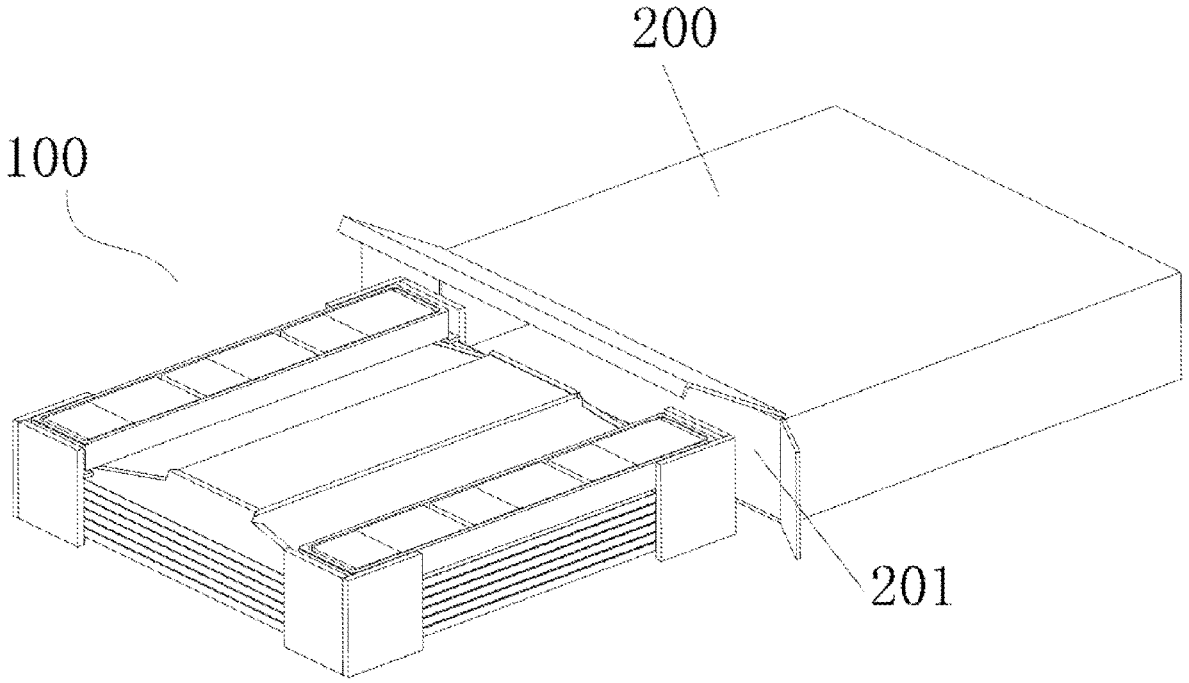
FIG. 8 is a structural schematic view of the packaging assembly about to be put into the accommodating cavity (201) of the box body (200)
Figure 9:
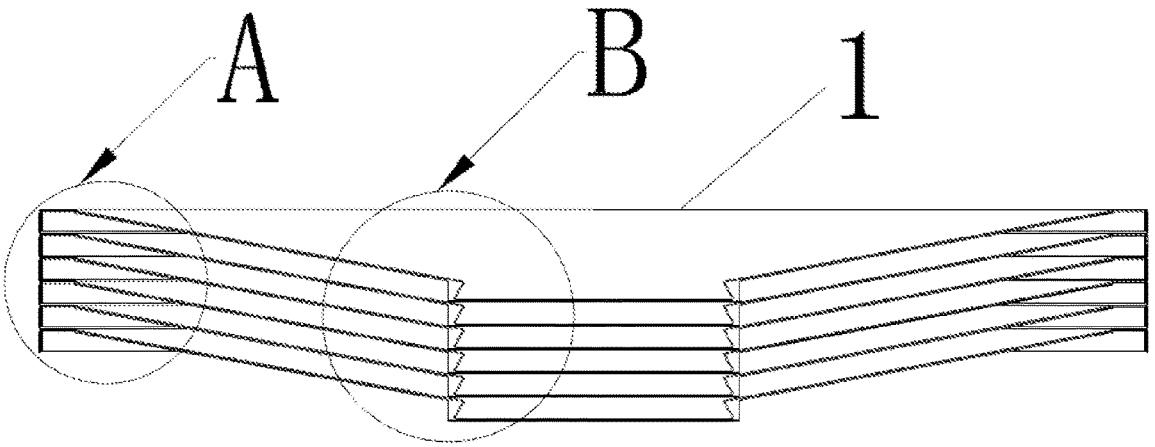
FIG. 9 is a schematic view (I) of the section of the stacked body.
Figure 10:
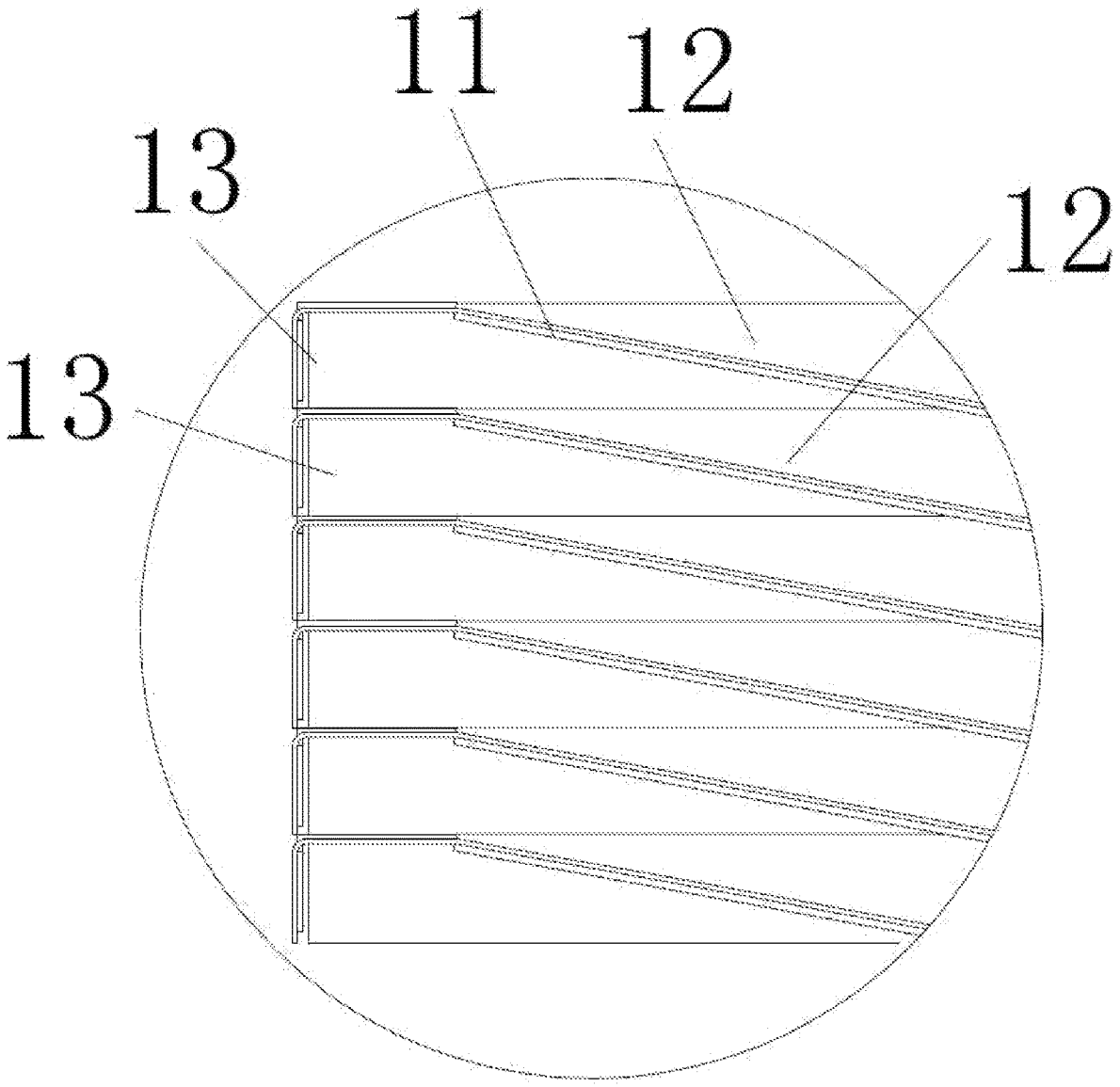
FIG. 10 is an enlarged view of Position A.
Figure 11:
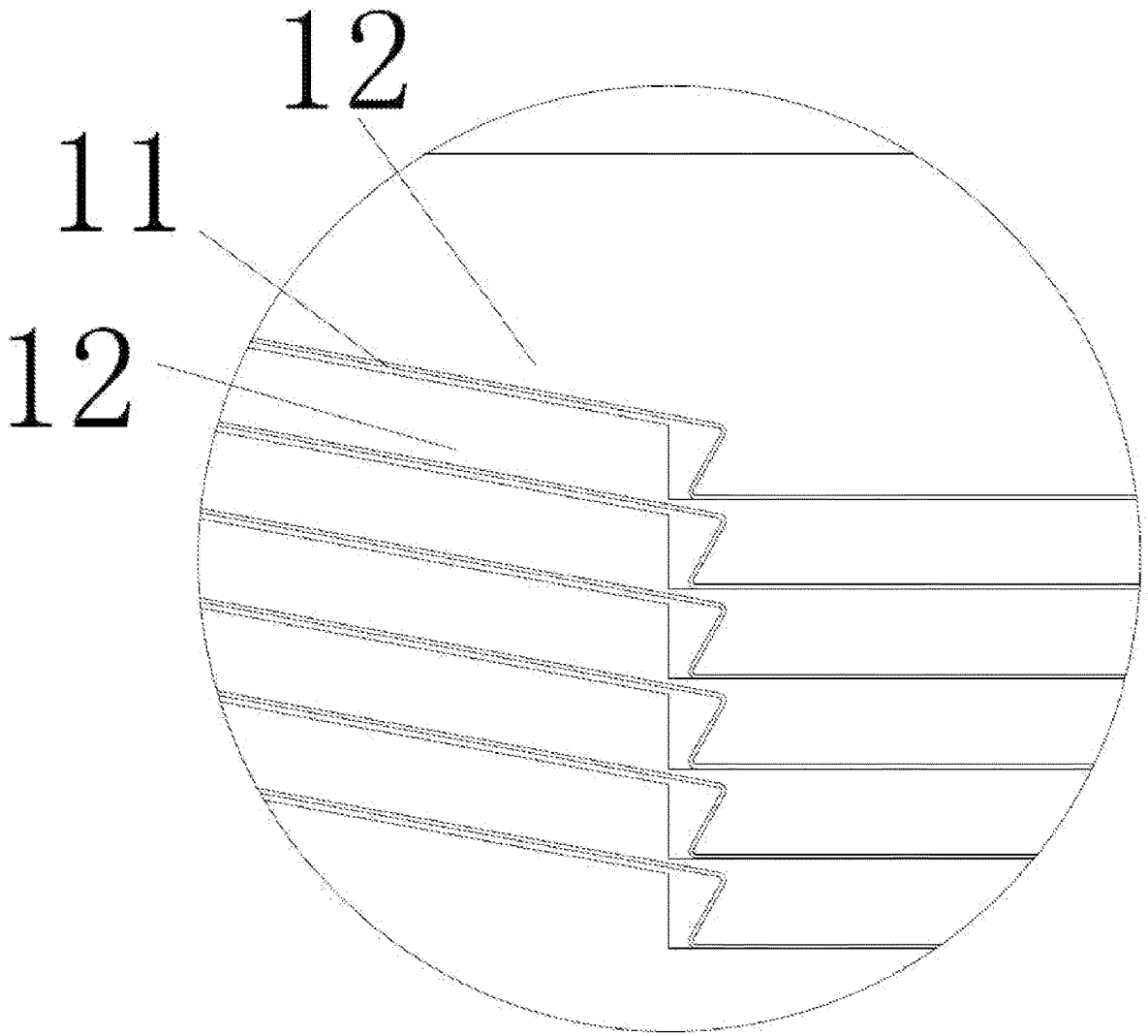
FIG. 11 is an enlarged view of Position B.
Figure 12:
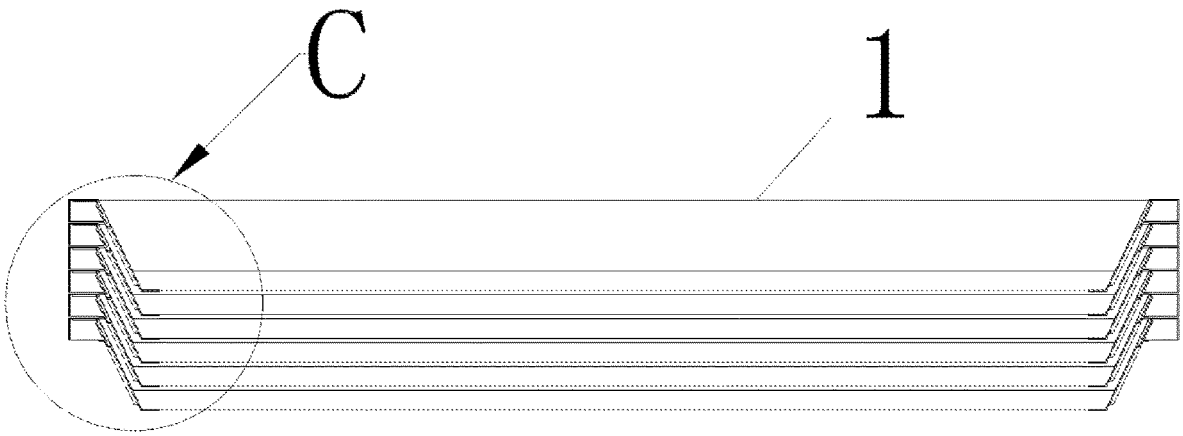
FIG. 12 is a schematic view (II) of the section of the stacked body.
Figure 13:
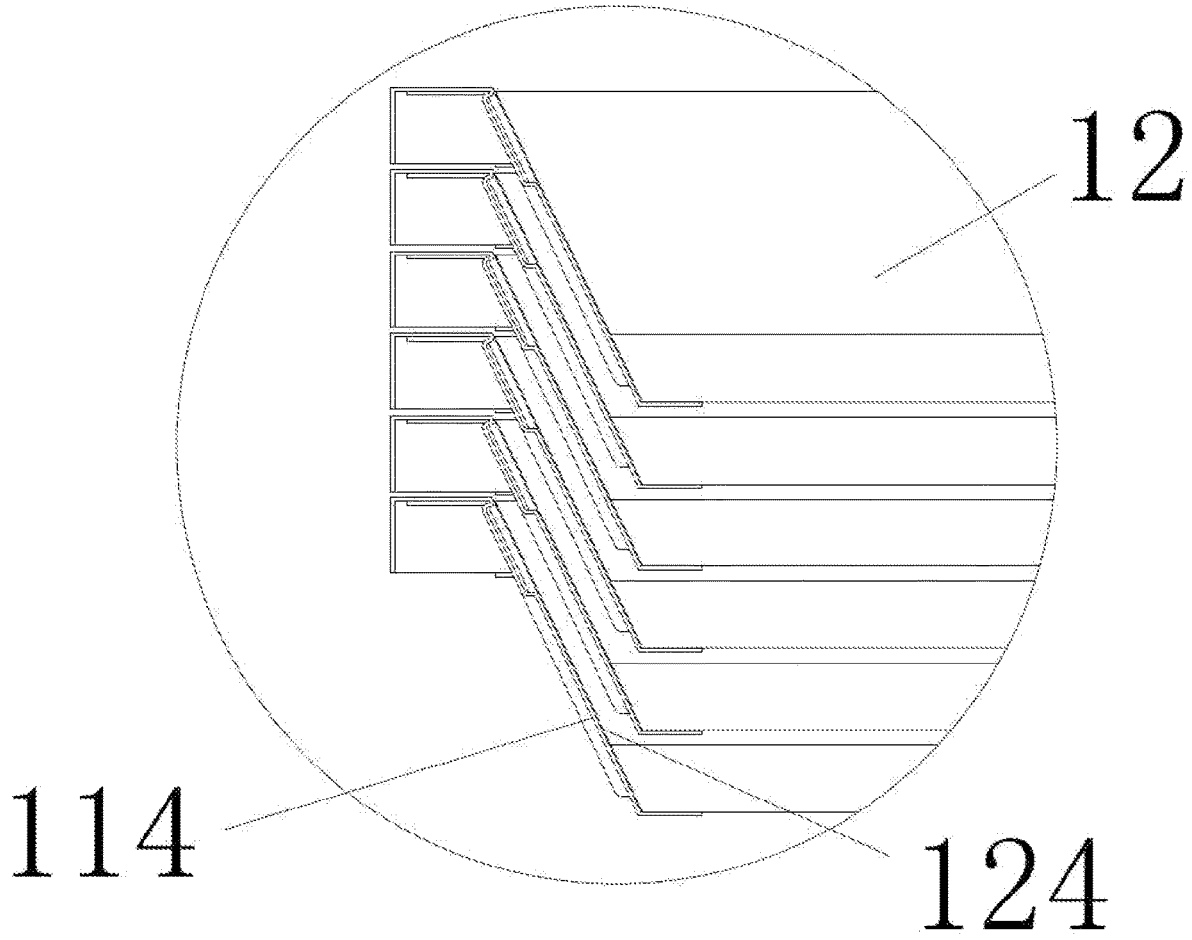
FIG. 13 is an enlarged view of Position C.
Figure 14:
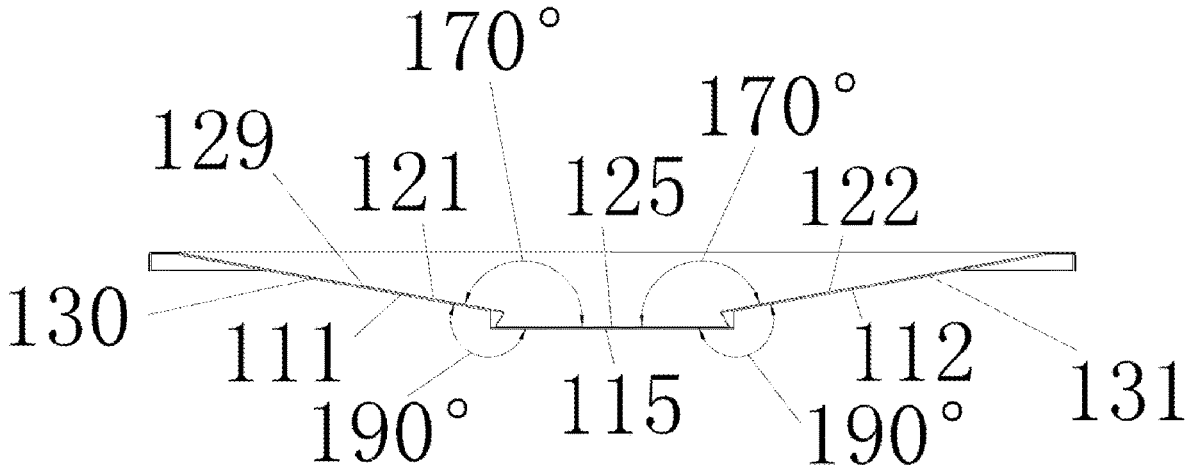
FIG. 14 is a schematic view (I) of the section of an individual lampshade (1)
Figure 15:
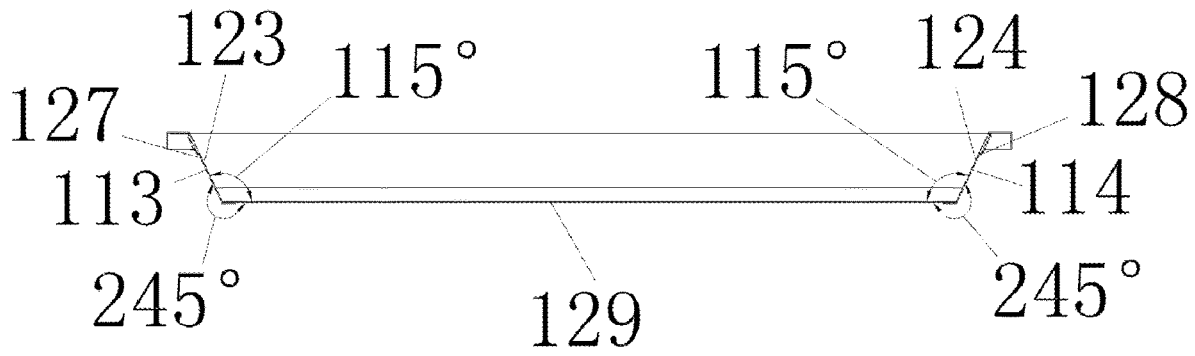
FIG. 15 is a schematic view (II) of the section of an individual lampshade (1)
Figure 16:
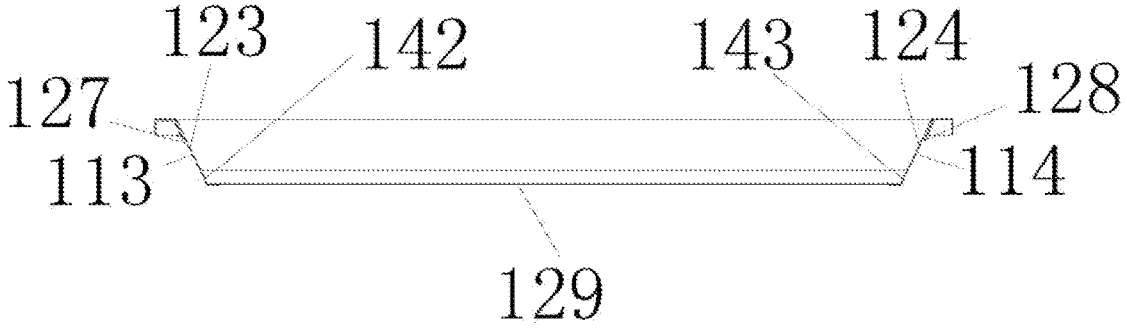
FIG. 16 is a schematic view (III) of the section of an individual lampshade (1)
Figure 17:
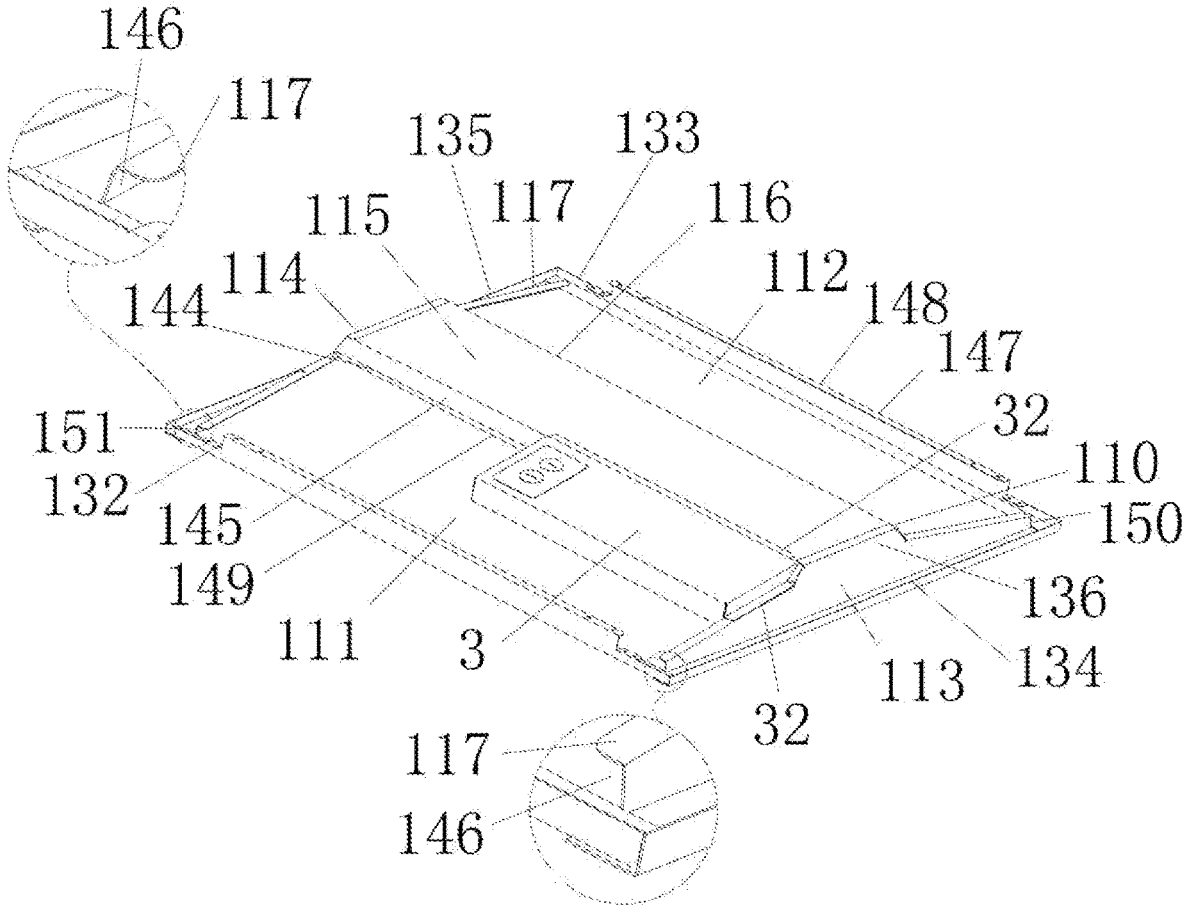
FIG. 17 is a structural diagram (I) of another lighting fixture.
Figure 18:
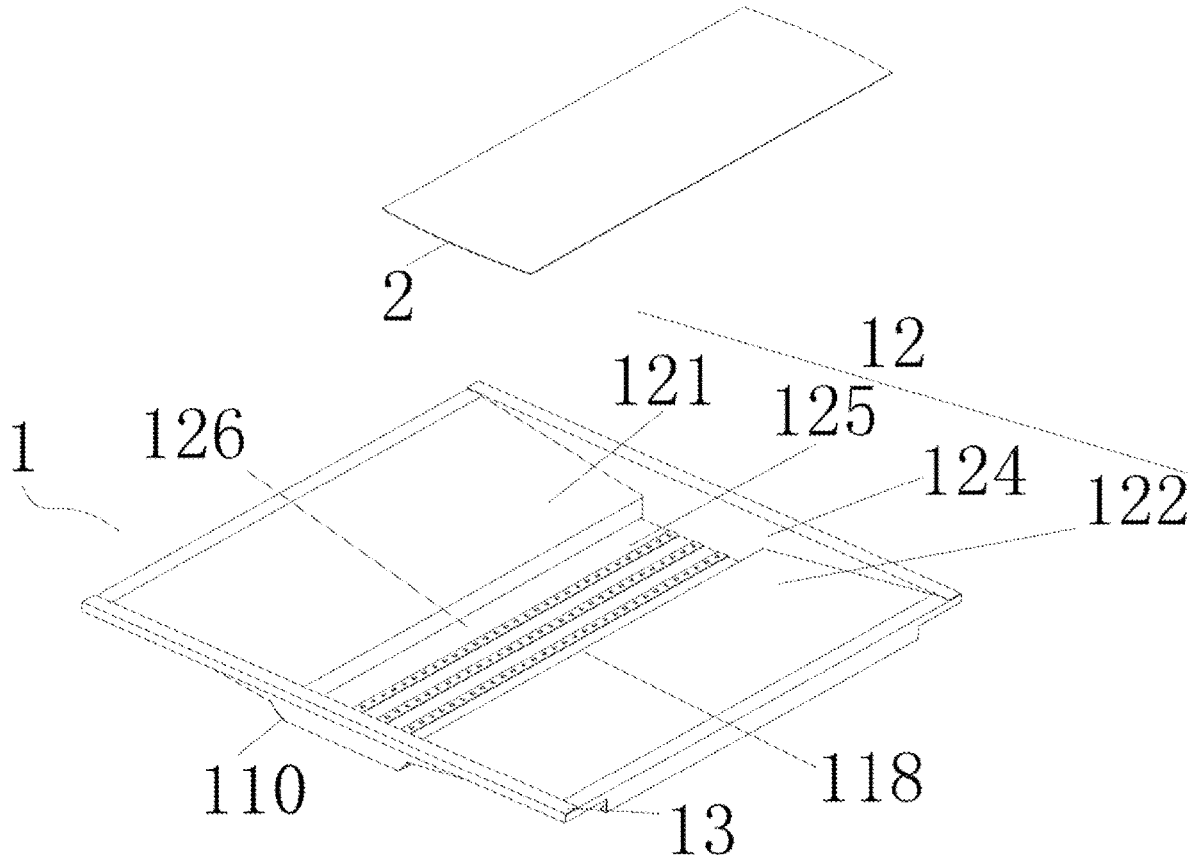
FIG. 18 is a structural diagram (II) of another lighting fixture.
Figure 19:
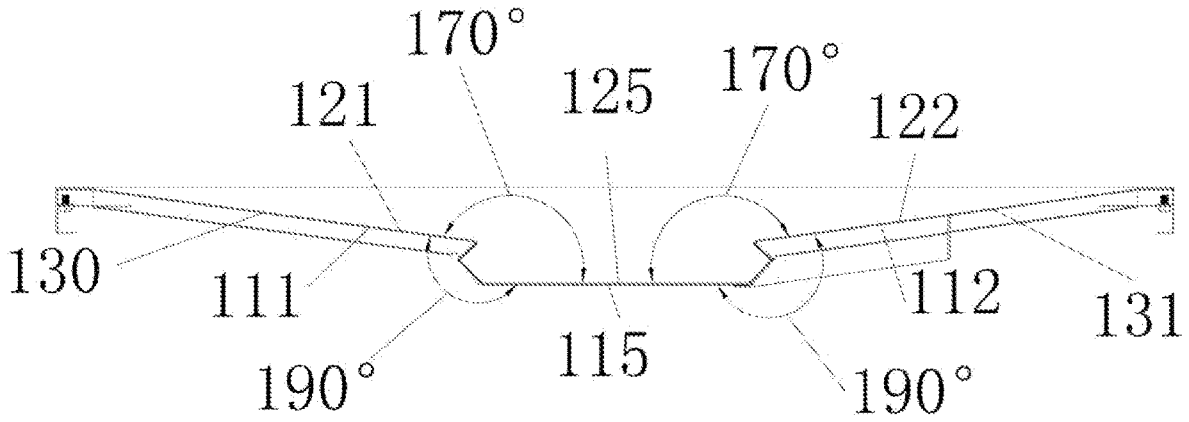
FIG. 19 is a structural schematic view (I) of the section of the lampshade of another lighting fixture.
Figure 20:
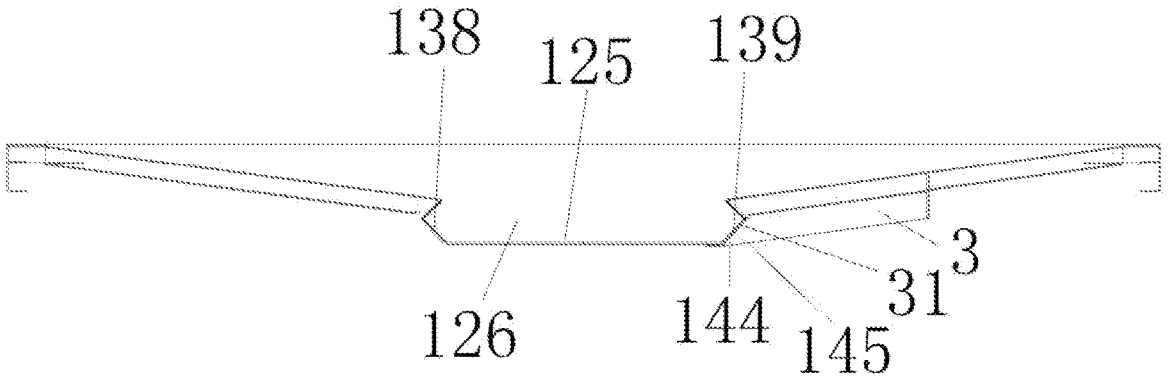
FIG. 20 is a structural schematic view (II) of the section of the lampshade of another lighting fixture.
Figure 21:
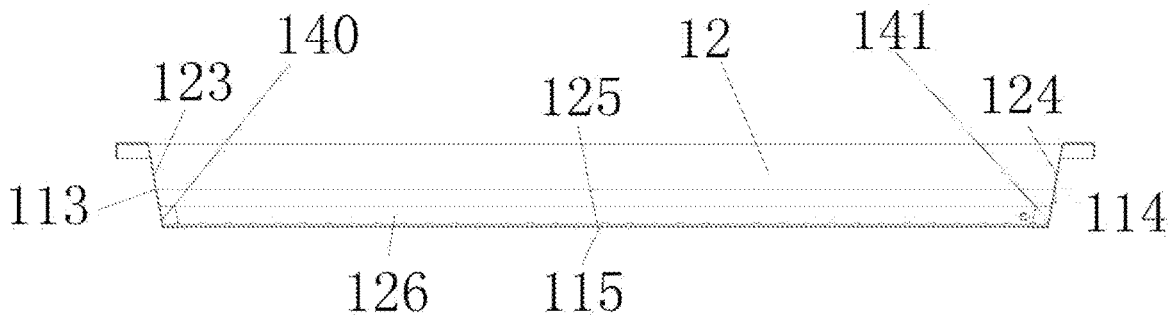
FIG. 21 is a structural schematic view (III) of the section of the lampshade of another lighting fixture.
Figure 22:
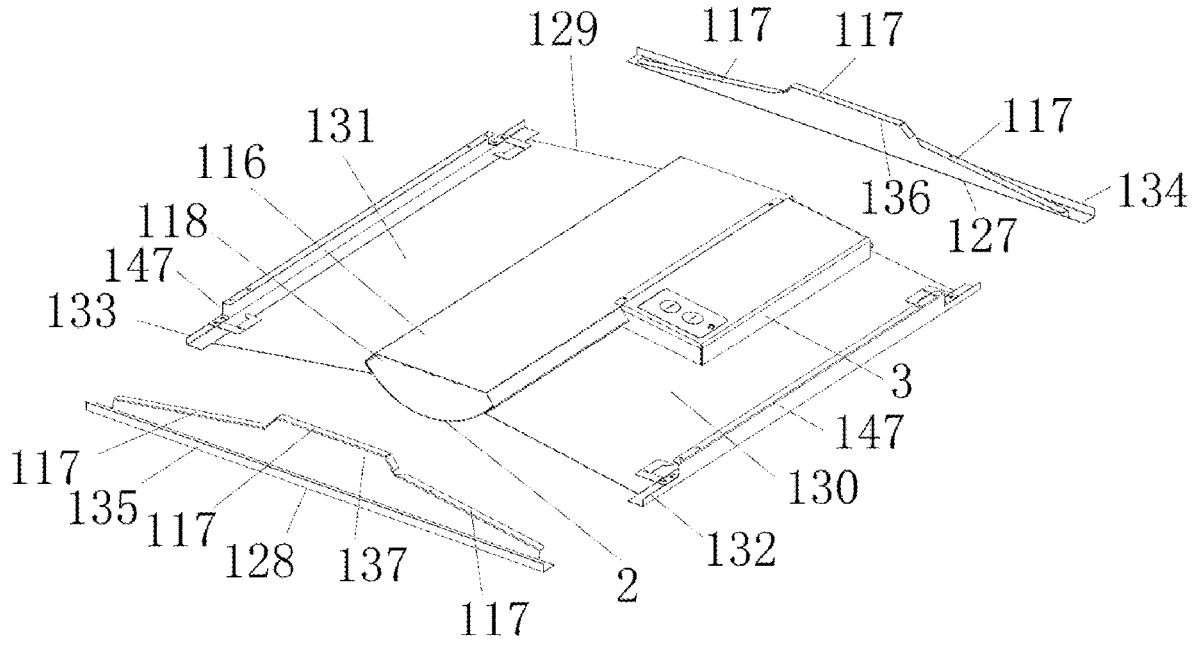
FIG. 22 is an exploded structural diagram of another lighting fixture.
Figure 23:
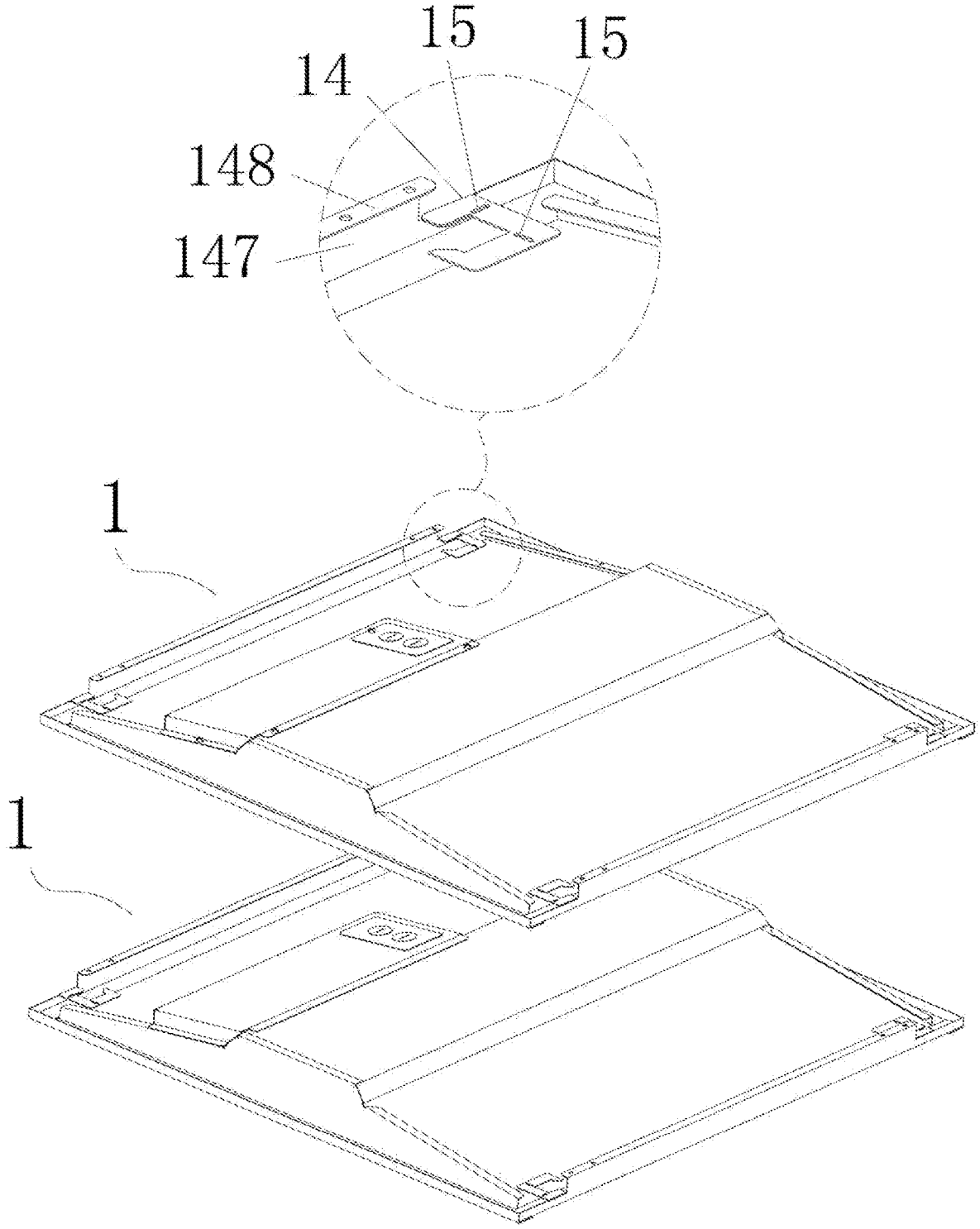
FIG. 23 is a structural schematic view of multiple lighting fixtures before stacking.
Figure 24:
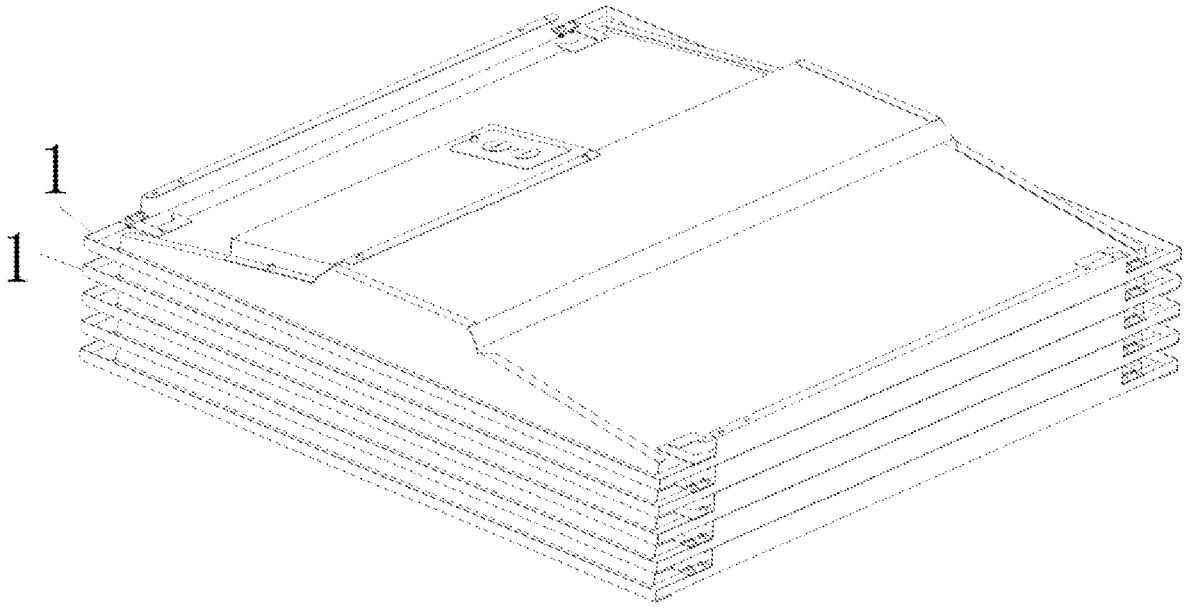
FIG. 24 is a structural schematic view (I) of multiple lighting fixtures after stacking.
Figure 25:
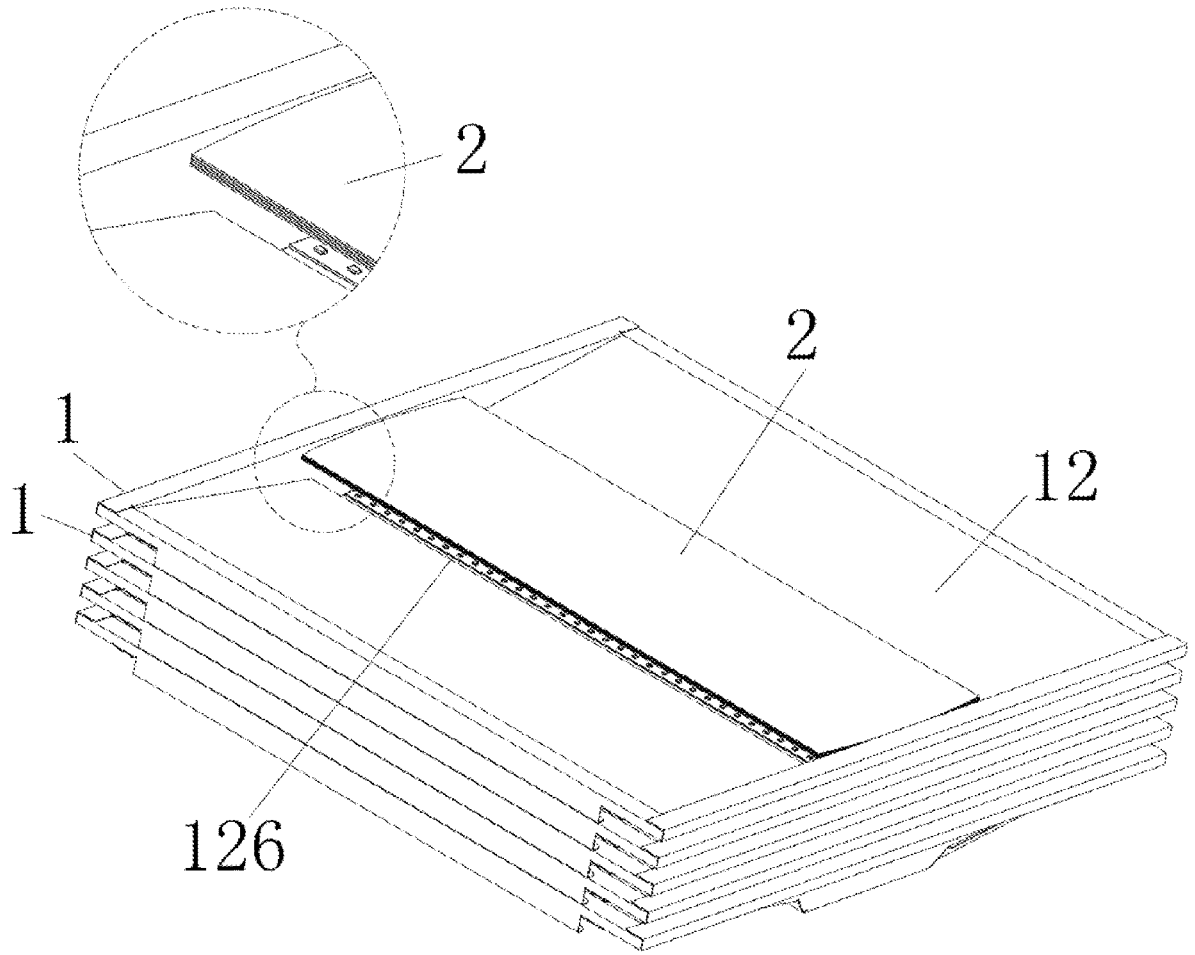
FIG. 25 is a structural schematic view (II) of multiple lighting fixtures after stacking.
Figure 26:
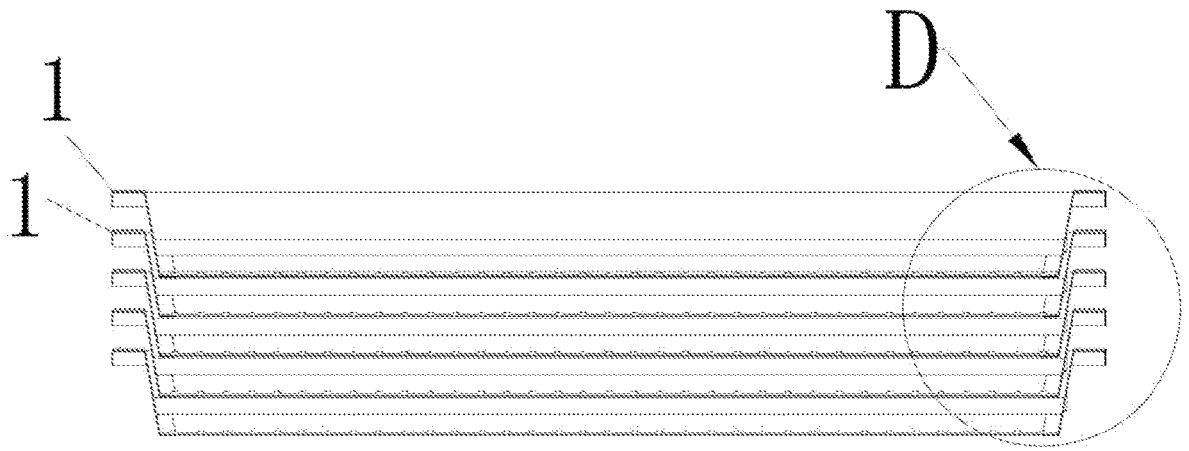
FIG. 26 is a structural schematic view (III) of the section of multiple lighting fixtures after stacking.
Figure 27:
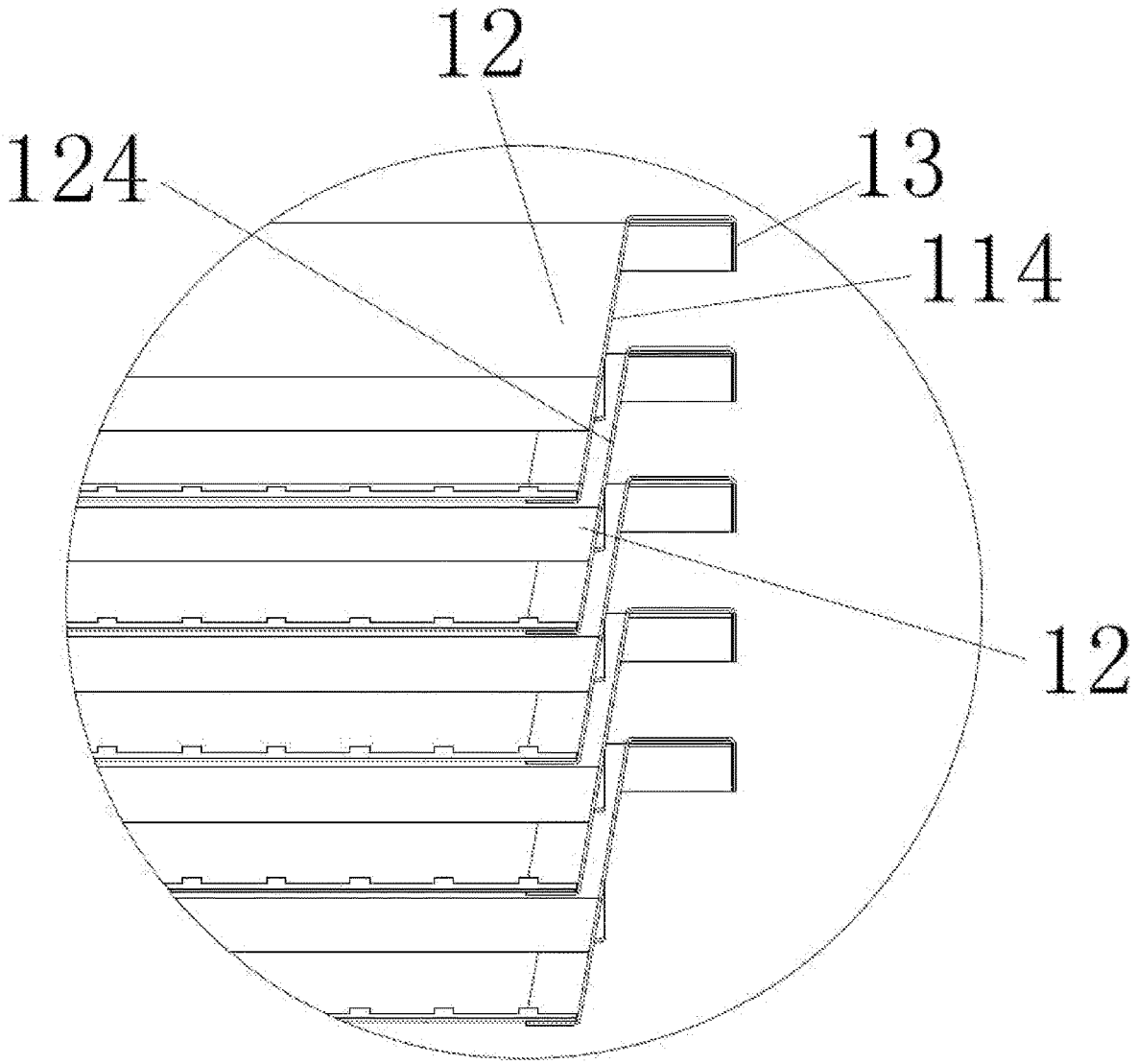
FIG. 27 is an enlarged view of Position D.
Figure 28:
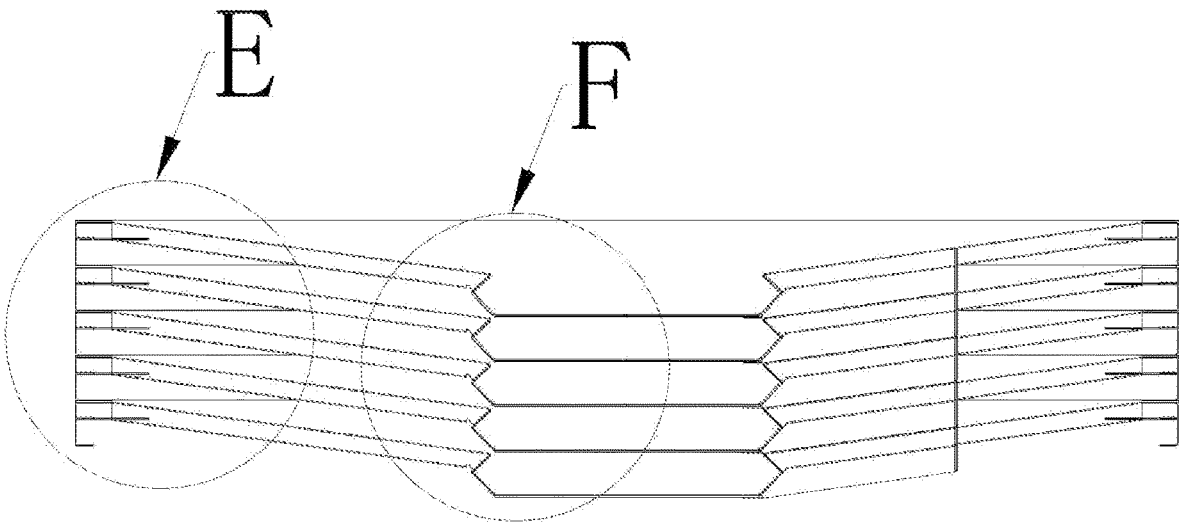
FIG. 28 is a structural schematic view (III) of the section of multiple lighting fixtures after stacking.
Figure 29:
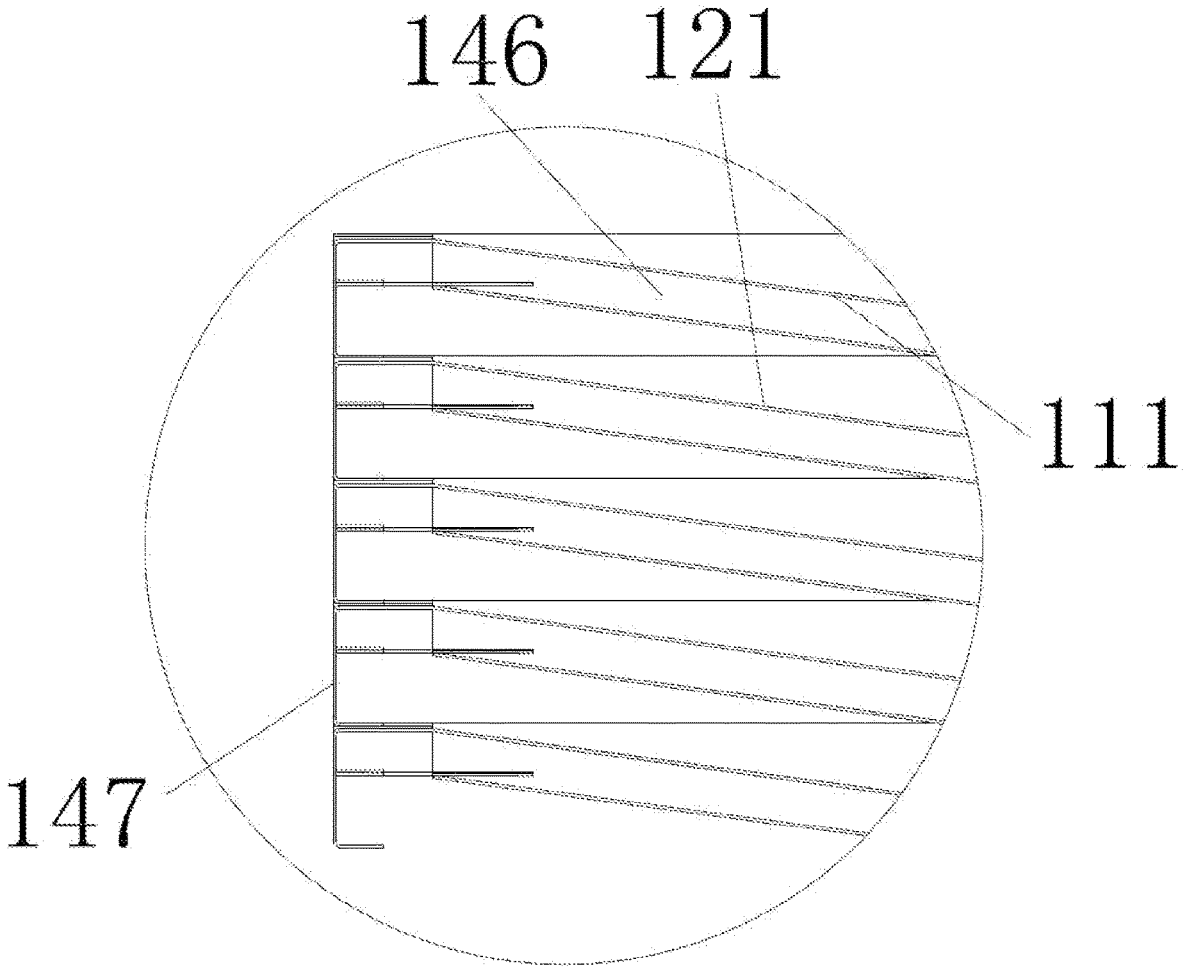
FIG. 29 is an enlarged view of Position E.
Figure 30:
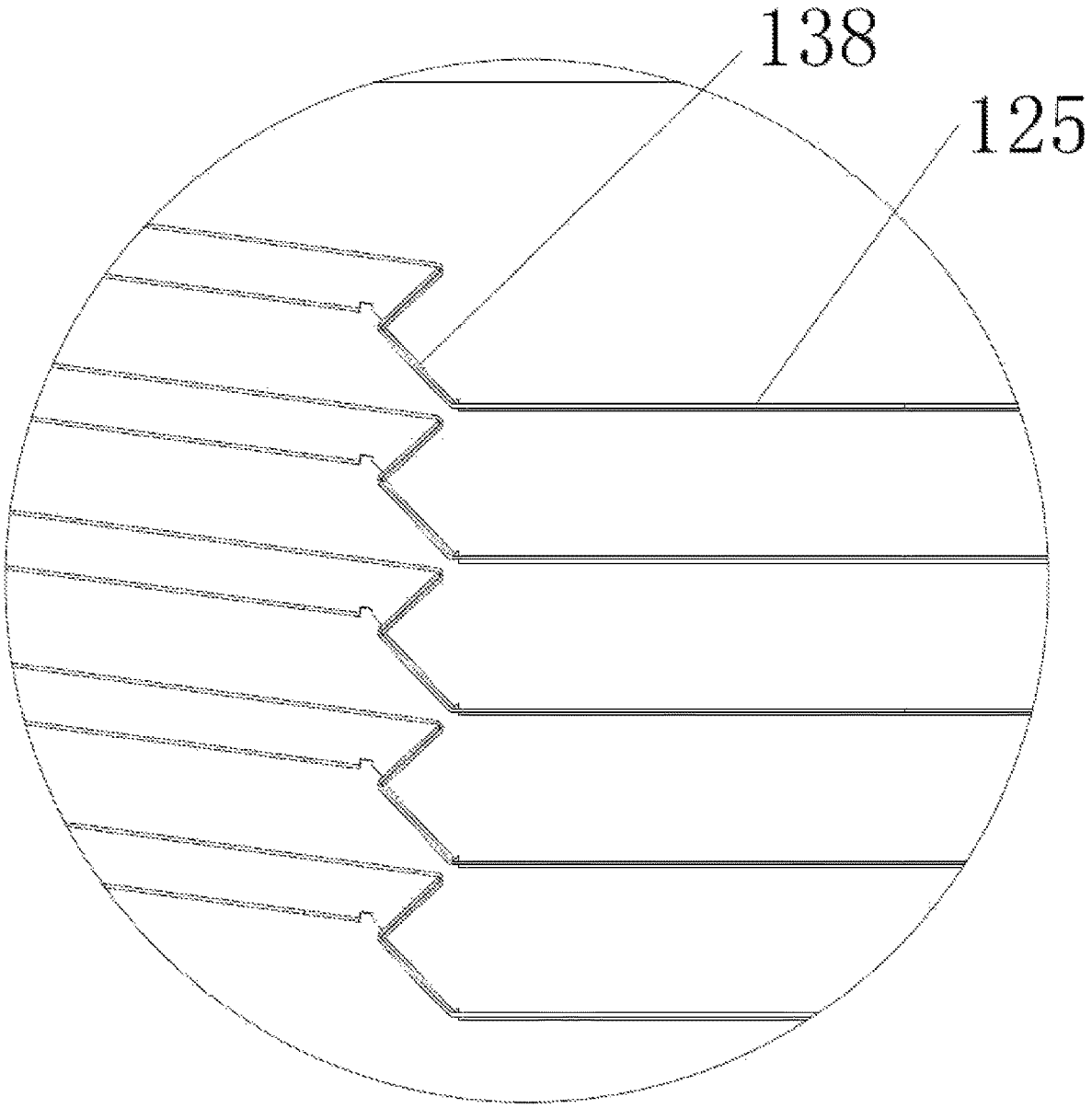
FIG. 30 is an enlarged view of Position F.

As illustrated in FIG. 1-FIG. 30, this embodiment describes a lighting fixture convenient to pack, which consists of a lampshade 1; the lampshade 1 consists of a hood body 11 with a cavity 12 and a frame 13 at the opening edge of the hood body 11, and the frame 13 is away from the cavity 12; the cavity 12 is used to accommodate the luminous source of the lighting fixture; the hood body 11 consists of the first oblique outer wall surface 111, the second oblique outer wall surface 112, the third oblique outer wall surface 113, and the fourth oblique outer wall surface 114; the cavity 12 of the hood body 11 consists of the first oblique inner wall surface 121 corresponding to the first oblique outer wall surface 111, the second oblique inner wall surface 122 corresponding to the second oblique outer wall surface 112, the third oblique inner wall surface 123 corresponding to the third oblique outer wall surface 113, and the fourth oblique inner wall surface 124 corresponding to the fourth oblique outer wall surface 114; the first oblique outer wall surface 111 and the second oblique outer wall surface 112 are arranged opposite to each other, while the third oblique outer wall surface 113 and the fourth oblique outer wall surface 114 are arranged opposite to each other; the first oblique inner wall surface 121 and the second oblique inner wall surface 122 are arranged opposite to each other, while the third oblique inner wall surface 123 and the fourth oblique inner wall surface 124 are arranged opposite to each other. The angle of inclination of wall surface and the frame 13 away from the inner cavity are arranged to ensure that, upon the stacking, the hood body 11 of one lampshade 1 is inserted into the inner cavity of the other lampshade 1, and after the stacking, the hood body 11 and the inner cavity wall do not have any contact.

In this embodiment, the lampshade 1 also consists of a bulge part 110 on the hood body 11, the bulge part 110 consists of a concave cavity 126 connected with the cavity 12, and the luminous source of the lighting fixture is placed in the concave cavity 126. The structural arrangement ensures that the luminous source can conduct effective locating. In addition, the luminous source is an LED lamp panel, and the panel 2 can be covered at the concave cavity 126.

In this embodiment, the included angle between the first oblique outer wall surface 111/the second oblique outer wall surface 112 and the horizontal outer wall surface 115 of the bulge part 110 is a, while the included angle between the third oblique outer wall surface 113/the fourth oblique outer wall surface 114 and the horizontal outer wall surface 115 of the bulge part 110 is b; a is an obtuse angle, and b is a reflex angle, so a is smaller than b ($a<b$); the included angle between the first oblique inner wall surface 121/the second oblique inner wall surface 122 and the horizontal inner wall surface 125 of the bulge part 110 is c, while the included angle between the third oblique inner wall surface 123/the fourth oblique inner wall surface 124 and the horizontal inner wall surface 125 of the bulge part 110 is d; a is an obtuse angle, and b is a reflex angle, so c is smaller than d ($c<d$); the arrangement prepares for the stacking of multiple lampshades; the first oblique inner wall surface 121, the second oblique inner wall surface 122, the third oblique inner wall surface 123, and the fourth oblique inner wall surface 124 may be applied with white coating or arranged on the bright surface to ensure that the residual light after the luminescence of the luminous source can be reflected to improve the lighting effect of the lighting fixture; as a result, better lighting effect can be realized even the LED lamp panel is smaller; since the LED lamp panel is smaller, the quantity of lamp beads is smaller, so the energy saving is realized during the illumination.

In this embodiment, the lampshade 1 also consists of an elongated plate 129 and the first oblique side plate 127 and the second oblique side plate 128 located at the edges of two opposite sides of the elongated plate 129; the elongated plate 129 is bent to form the second convex part 116 located in the middle and with a channel 118, the first oblique piece 130 and the second oblique piece 131 located on two opposite sides of the second convex part 116; the first edging 132 and the support 147 on the first edging 132 are formed at the side edge of the first oblique piece 130, while the second edging 133 and the support 147 on the second edging 133 are formed at the side edge of the second oblique piece 131; the first convex piece 136 and the third edging 134 are formed on the first oblique side plate 127, while the second convex piece 137 and the fourth edging 135 are formed on the second oblique side plate 128; the first edging 132, the second edging 133, the third edging, 134 and the fourth edging 135 are connected end to end to form the frame 13; specifically, two ends of the third edging 134 are respectively welded to one end of the first edging 132 and one end of the second edging 133, two ends of the fourth edging 135 are respectively welded to the other end of the first edging 132 and the other end of the second edging 133, the elongated plate 129, the first oblique side plate 127, and the second oblique side plate 128 are made of metal plates, and each edging is bent to the required shape.

One port of the second convex part 116 fits the first convex piece 136 to close one end of the channel 118, and the other port of the second convex part 116 fits the second convex piece 137 to close the other end of the channel 118, thus forming the bulge part 110 and the concave cavity 126 in the bulge part 110; one end of the first oblique piece 130 and one end of the second oblique piece 131 fit the first oblique side plate 127, and the other end of the first oblique piece 130 and the other end of the second oblique piece 131 fit the second oblique side plate 128; the first oblique outer wall surface 111 is formed on the outer wall of the first oblique piece 130, the second oblique outer wall surface 112 is formed on the outer wall of the first oblique piece 130, and the third oblique outer wall surface 113 is formed on the outer wall of the first oblique side plate 127, and the fourth oblique outer wall surface 114 is formed on the outer wall of the second oblique side plate 128; the first oblique inner wall surface 121 is formed on the inner wall of the first oblique piece 130, the second oblique inner wall surface 122 is formed on the inner wall of the first oblique piece 130, the third oblique inner wall surface 123 is formed on the inner wall of the first oblique side plate 127, and the fourth oblique inner wall surface 124 is formed on the inner wall of the second oblique side plate 128.

The structural arrangement of the lampshade 1 makes it easy to assemble the lampshade 1 of the lighting fixture, and the assembled lampshade is stable and reliable.

Specifically, the included angle between the first oblique outer wall surface 111/the second oblique outer wall surface 112 and the horizontal outer wall surface 115 is 190°, the included angle a between the third oblique outer wall surface 113/the fourth oblique outer wall surface 114 and the horizontal outer wall surface 115 is 200°, the included angle between the first oblique inner wall surface 121/the second oblique inner wall surface 122 and the horizontal inner wall surface 125 is 170°, and the included angle between the third oblique inner wall surface 123/the fourth oblique inner wall surface 124 and the horizontal inner wall surface 125 is 100°.

Embodiment II

As illustrated in FIG. 17-FIG. 22, this embodiment describes a lighting fixture convenient to pack, the structure of which is similar to that described in Embodiment I, and the difference from that described in Embodiment I is as follows: an actuator 3 is arranged obliquely; the actuator 3 is arranged on the side of the hood body 11 that is away from the second oblique outer wall surface 112 and on the first oblique outer wall surface 111; and the angle of inclination of the actuator 3 is the same as the angle with the first oblique outer wall surface 111; therefore, after the actuator 3 is installed on the lampshade 1, the supports 147 must be arranged on the first edging 132 and the second edging 133 opposite to each other in the frame 13; each support 147 consists of a supporting plane 148; as a result, after multiple lighting fixtures are stacked, there may also be spacing between the outer surface of the actuator 3 and the first oblique inner wall surface 121 to prevent the inner wall surface of the lampshade 1 from being worn and scratched; and the supports 147 on the first edging and the second edging are also formed by bending.

Further, the horizontal hook plates 14 are connected by bolts to the left and right sides of the support 147 on the first edging and the left and right sides of the support 147 on the second edging; an elongated hole 15 is arranged respectively at the tail end and middle part of the horizontal hook plate 14; therefore, the hook plate 14 may be bent from the elongated hole at the tail end to the vertical direction, and the hook plate 14 may be bent from the elongated hole 15 in the middle part towards the hood body to the horizontal direction, thus forming a hook in the vertical direction; as a result, the hook may be clipped on the ceiling to prevent the installed lighting fixture from dropping and make the installed lighting fixture stable and reliable.

In this embodiment, the first convex part 144 is formed on the side of the bulge part 110 that is away from the second oblique outer wall surface 112; the oblique supporting surface of the first convex part 144 fits the inclined plane 31 of the actuator 3; a fixing piece 33 is formed on the edge of the inclined plane 31 of the actuator 3, the fixing piece 33 is fixed by bolts on the horizontal outer wall surface 115 of the bulge part 110, wherein the arrangement of the first convex part 144 makes the installed actuator stable and reliable.

In this embodiment, the concave cavity 126 consists of the fifth oblique inner wall surface 140, the sixth oblique inner wall surface 141, the first V-shaped concave 138, and the second V-shaped concave 139; the fifth oblique inner wall surface 140 and the sixth oblique inner wall surface 141 are arranged opposite to each other; the first V-shaped concave 138 and the second V-shaped concave 139 are arranged opposite to each other; the included angle between the fifth oblique inner wall surface 140/the sixth oblique inner wall surface 141 and the horizontal inner wall surface 125 in the concave cavity 126 is an obtuse angle; generally, the oblique wall surface near the horizontal inner wall surface on the fifth oblique inner wall surface 140, the sixth oblique inner wall surface 141, and the first V-shaped concave 138, as well as the oblique wall surface near the horizontal inner wall surface on the second V-shaped concave 139, are applied with white coating or arranged on the bright surface; as a result, the light emitted by the luminous source can be fully reflected to improve the lighting effect. The fifth oblique inner wall surface 140 and the third oblique inner wall surface 123 are combined into an integrated oblique inner wall surface, while the sixth oblique inner wall surface 141 and the fourth oblique inner wall surface 124 are combined into an integrated oblique inner wall surface. The oblique wall surface near the opening of the concave cavity on the first V-shaped concave 138 and the oblique wall surface near the opening of the concave cavity on the second V-shaped concave 139 are clipped and fit two opposite sides of the panel 2 respectively, and the panel 2 is deformed into an arc shape.

In this embodiment, at least one of the inner wall of the first oblique side plate 127 facing the first oblique piece 130, the inner wall of the first oblique side plate 127 facing the second oblique piece 131, the inner wall of the second oblique side plate 128 facing the first oblique piece 130, and the inner wall of the second oblique side plate 128 facing the second oblique piece 131 has a storage groove for storage the cables; to accommodate more cables, all of the inner wall of the first oblique side plate 127 facing the first oblique piece 130, the inner wall of the first oblique side plate 127 facing the second oblique piece 131, the inner wall of the second oblique side plate 128 facing the first oblique piece 130, and the inner wall of the second oblique side plate 128 facing the second oblique piece 131 have the storage grooves for the storage of cables, and all of the inner wall of the first oblique side plate 127 facing the first oblique piece 130, the inner wall of the first oblique side plate 127 facing the second oblique piece 131, the inner wall of the second oblique side plate 128 facing the first oblique piece 130, and the inner wall of the second oblique side plate 128 facing the second oblique piece 131 have the locating pieces; the storage groove is formed between the locating piece and the oblique side plate to prevent the potential safety hazards arising from the exposure of cables; the edge of the actuator also extends to form a fixing piece 33, and the fixing piece 33 is fixed by the bolts on the locating piece.

As illustrated in FIG. 23-FIG. 30, in addition, the embodiment describes a lighting fixture assembly method of packaging multiple lighting fixtures based on Embodiment II. The method involves multiple lighting fixtures based on Embodiment II. The lampshades 1 of such lighting fixtures match each other and stack to form a stacked body; for two adjacent lampshades 1, one lampshade 1 is placed on the other lampshade 1, so at least one part of the hood body 11 of one lampshade 1 is placed in the cavity 12 of the hood body 11 in the other lampshade 1; the support 147 on the frame 13 of one lampshade 1 fits the frame 13 of the other lampshade 1, the first oblique outer wall surface 111 of one lampshade 1 and the first oblique inner wall surface 121 of the other lampshade 1 have certain spacing, the second oblique outer wall surface 112 of one lampshade 1 and the second oblique inner wall surface 122 of the other lampshade 1 have certain spacing, the third oblique outer wall surface 113 of one lampshade 1 and the third oblique inner wall surface 123 of the other lampshade 1 have certain spacing, the fourth oblique outer wall surface 114 of one lampshade 1 and the fourth oblique inner wall surface 124 of the other lampshade 1 have certain spacing, and the horizontal outer wall surface 115 of one lampshade 1 and the horizontal inner wall surface 125 of the other lampshade 1 have certain spacing; the outer wall of the actuator and the first oblique inner wall surface 121 have certain spacing; the quantity of lighting fixtures is 2-6; accordingly, the quantity of lampshade 1 is also 2-6; the support 147 on the frame 13 is used to support the hood body 11 to form the spacing between the outer wall of the hood body 11 of one lampshade 1 and the inner wall of the cavity 12 of the other lampshade 1; the spacing is set to prevent the friction between the outer wall of one lampshade 1 and the inner wall of the other lampshade 1, thus avoiding the scratches on the wall surface of the lampshade 1.

Based on the assembly method, alternatively, after the stacking of multiple lampshades 1, multiple independent panels 2 can be assembled in a box body 200, and such panels 2 are stacked with each other and then placed in the cavity 12 of the lampshade 1 at the very bottom of the stacked lampshades 1. The number of "multiple panels 2" is 2-6. The panels 2 are stacked and then placed in the cavity 12 of the bottom lampshade 1 of the stacked body, so that the panels 2 can be assembled without occupying other space of the box body 200.

Embodiment III

As illustrated in FIG. 1-FIG. 16, this embodiment describes a lighting fixture convenient to pack, the structure of which is similar to that described in Embodiment I, and the difference from that described in Embodiment I is as follows: the locating pieces are formed on the inner wall of the first oblique side plate 127 facing the first oblique piece 130, the inner wall of the first oblique side plate 127 facing the second oblique piece 131, the inner wall of the second oblique side plate 128 facing the first oblique piece 130, the inner wall of the second oblique side plate 128 facing the second oblique piece 131, the convex piece inner wall of the first oblique side plate 127, and the convex piece inner wall of the second oblique side plate 128; the locating pieces fit the outer wall of the first oblique piece 130, the outer wall of the second oblique piece 131, and the horizontal outer wall surface 115 respectively; after the fitting, the ultrasonic welding is performed to enhance the structural stability of the lampshade 1.

In this embodiment, the concave cavity 126 consists of the seventh oblique inner wall surface 142 and the eighth oblique inner wall surface 143; the included angle between the seventh oblique inner wall surface 142/the eighth oblique inner wall surface 143 and the horizontal inner wall surface 125 in the concave cavity 126 is an obtuse angle; generally, the seventh oblique inner wall surface 142 and the eighth oblique inner wall surface 143 are applied with white coating or arranged on the bright surface; as a result, the light emitted by the luminous source can be fully reflected to improve the lighting effect; the seventh oblique inner wall surface 142 and the third oblique inner wall surface 123 are combined into an integrated oblique inner wall surface, while the eighth oblique inner wall surface 143 and the fourth oblique inner wall surface are combined into an integrated oblique inner wall surface.

Specifically, the included angle between the first oblique outer wall surface 111/the second oblique outer wall surface 112 and the horizontal outer wall surface 115 is 190°, the included angle a between the third oblique outer wall surface 113/the fourth oblique outer wall surface 114 and the horizontal outer wall surface 115 is 245°, the included angle between the first oblique inner wall surface 121/the second oblique inner wall surface 122 and the horizontal inner wall surface 125 is 170°, and the included angle between the third oblique inner wall surface 123/the fourth oblique inner wall surface 124 and the horizontal inner wall surface 125 is 115°.

This embodiment describes the packaging of multiple lighting fixtures based on the lighting fixture described in Embodiment II. The packaging involves multiple above-mentioned lighting fixtures. The lampshades 1 of such lighting fixtures match each other and stack to form a stacked body; for two adjacent lampshades 1, one lampshade 1 is placed on the other lampshade 1, so at least one part of the hood body 11 of one lampshade 1 is placed in the cavity 12 of the hood body 11 in the other lampshade 1; the frame 13 of one lampshade 1 fits the frame 13 of the other lampshade 1; the first oblique outer wall surface 111 of one lampshade 1 and the first oblique inner wall surface 121 of the other lampshade 1 have certain spacing, the second oblique outer wall surface 112 of one lampshade 1 and the second oblique inner wall surface 122 of the other lampshade 1 have certain spacing, the third oblique outer wall surface 113 of one lampshade 1 and the third oblique inner wall surface 123 of the other lampshade 1 have certain spacing, the fourth oblique outer wall surface 114 of one lampshade 1 and the fourth oblique inner wall surface 124 of the other lampshade 1 have certain spacing, and the horizontal outer wall surface 115 of one lampshade 1 and the horizontal inner wall surface 125 of the other lampshade 1 have certain spacing. The quantity of lighting fixtures is 2-6; accordingly, the quantity of lampshade 1 is also 2-6; the frame 13 is used to support the hood body 11 to form the spacing between the outer wall of the hood body 11 of one lampshade 1 and the inner wall of the cavity 12 of the other lampshade 1; the spacing is set to prevent the friction between the outer wall of the lampshade 1 and the inner wall of the lampshade 1 and avoid any scratches on the outer wall of the lampshade 1.

Alternatively, after the stacking of multiple lampshades 1, multiple independent panels 2 can be assembled in a box body 200, and such panels 2 are stacked with each other and then placed in the cavity 12 of the lampshade 1 at the very bottom of the stacked lampshades 1. The number of "multiple panels 2" is 2-6. The panels 2 are stacked and then placed in the cavity 12 of the bottom lampshade 1 of the stacked body, so that the panels 2 can be assembled without occupying other space of the box body 200.

In order to ensure the stability after stacking, four protective shells can be set at the four corners of the stacked body, the protective shells supported by plastic materials, the four protective shells are respectively the first protective shell 4, the second protective shell 5, the third protective shell 6, and the fourth protective shell 7; the first protective shell 4, the second protective shell 5, the third protective shell 6, and the fourth protective shell 7 are respectively sleeved on the four corners of the stacked body; the protective shells are used to protect the four corners of lampshade 1 to prevent the corners of lampshade 1 from colliding with hard objects during packaging.

The inner walls of the positioning cavities of the first protective shell 4, the second protective shell 5, the third protective shell 6, and the fourth protective shell 7 are arranged with the first baffle bar 41 and the second baffle bar 42; the first baffle bar 41 fits the top of the frame 13 of the top lampshade 1 in the stacked body, and the second baffle bar 42 fits the bottom of the frame 13 of the bottom lampshade 1 in the stacked body. The structural arrangement ensures that all stacked lampshades 1 are limited by the first baffle bar 41 and the second baffle bar 42 to realize the stable stacking, and all lampshades 1 fit tightly.

Two ends of the first storage box 8 are placed in the positioning cavity of the first protective shell 4 and the positioning cavity of the second protective shell 5 respectively; the bottom surface of the first storage box 8 is placed on the top surface of the first baffle bar 41, and multiple actuators are arranged in the first storage box 8. The storage box can be set to accommodate the actuators. Generally, one storage box can accommodate three actuators, so the packaging of three lighting fixtures only requires one storage box.

Two ends of the second storage box 9 are placed in the positioning cavity of the third protective shell 6 and the positioning cavity of the fourth protective shell 7 respectively; the bottom surface of the second storage box 9 is placed on the top surface of the first baffle bar 41, and multiple actuators 3 are arranged in the second storage box 9. The second storage box 9 has the same length as that of the first storage box 8, so it can also accommodate the actuators 3. Therefore, for the assembly of six lighting fixtures, two storage boxes are needed for the placement of the actuators 3.

A box body 200 for packaging 2-6 lighting fixtures is used. The said lighting fixture assembly 100 formed by the said stacked body, the four protective shells, the first storage box 8, the second storage box 9, and multiple actuators 3 are placed in the accommodating cavity 201 of the box body 200, and the outer walls of the four protective shells fit the inner walls of the accommodating cavity 201 of the box body 200, thus realizing the stacking and assembly of 2-6 lighting fixtures in one box body 200.

The present invention is not limited to the above-mentioned preferred embodiments. Anyone may get other products in various forms under the inspiration of the present invention. However, whatever changes are made in the shape or structure of the products, any products with the same or similar technical schemes to the present application will fall within the scope of protection of the present invention.

What is claimed is:

1. A lighting fixture convenient to pack, which is characterized in that the lighting fixture comprises a lampshade; the lampshade comprises a hood body with a cavity and a frame at the opening edge of the hood body; and the cavity of the hood body is used to accommodate a luminous source of the lighting fixture;

the hood body comprises a first oblique outer wall surface, a second oblique outer wall surface, a third oblique outer wall surface, and a fourth oblique outer wall surface; the cavity of the hood body comprises a first oblique inner wall surface corresponding to the first oblique outer wall surface, a second oblique inner wall surface corresponding to the second oblique outer wall surface, a third oblique inner wall surface corresponding to the third oblique outer wall surface, and a fourth oblique inner wall surface corresponding to the fourth oblique outer wall surface; the first oblique outer wall surface and the second oblique outer wall surface are arranged opposite to each other, while the third oblique outer wall surface and the fourth oblique outer wall surface are arranged opposite to each other; the first oblique inner wall surface and the second oblique inner wall surface are arranged opposite to each other, while the third oblique inner wall surface and the fourth oblique inner wall surface are arranged opposite to each other;

the lampshade also comprises a bulge part on the hood body, the bulge part comprises a concave cavity connected with the cavity, and the luminous source of the lighting fixture is placed in the concave cavity;

the frame comprises a first edging and a second edging arranged opposite to each other, and the first edging and the second edging are respectively equipped with the supports; and each support comprises a supporting plane.

2. A lighting fixture convenient to pack according to claim 1, which is characterized in that the frame further comprises a plurality of horizontal hook plates, each of which is connected by bolts to the left and right sides of the support on the first edging and the left and right sides of the support on the second edging; an elongated hole is arranged respectively at a tail end and middle part of the horizontal hook plate; therefore, the hook plate can be bent from the elongated hole at the tail end to a vertical direction, and the hook plate can be bent from the elongated hole in a middle part towards the hood body to a horizontal direction, thus forming a hook in a vertical direction.

3. A lighting fixture convenient to pack according to claim 2, which is characterized in that the hood body further comprises an actuator; the actuator is arranged on a side of the hood body that is away from the second oblique outer wall surface and on the first oblique outer wall surface; and an angle of inclination of the actuator is the same as the angle with the first oblique outer wall surface.

4. A lighting fixture convenient to pack according to claim 3, which is characterized in that a first convex part is formed on a side of the bulge part that is away from the second oblique outer wall surface; and the oblique supporting surface of the first convex part fits the inclined plane of the actuator.

5. A lighting fixture convenient to pack according to claim 4, which is characterized in that the concave cavity comprises a fifth oblique inner wall surface, a sixth oblique inner wall surface, a first V-shaped concave, and a second V-shaped concave; the fifth oblique inner wall surface and the sixth oblique inner wall surface are arranged opposite to each other; the first V-shaped concave and the second V-shaped concave are arranged opposite to each other; and the included angle between the fifth oblique inner wall surface and the sixth oblique inner wall surface and the horizontal inner wall surface in the concave cavity are both obtuse angles.

6. A lighting fixture convenient to pack according to claim 5, which is characterized in that an included angle between the first oblique outer wall surface and the second oblique outer wall surface and a horizontal outer wall surface of the bulge part are both a, while the included angle between the third oblique outer wall surface and the fourth oblique outer wall surface and the horizontal outer wall surface of the bulge part are both b; a is an obtuse angle, and b is a reflex angle, so a is smaller than b (a<b);

the included angle between the first oblique inner wall surface and the second oblique inner wall surface and the horizontal inner wall surface of the bulge part are both c, while the included angle between the third oblique inner wall surface and the fourth oblique inner wall surface and the horizontal inner wall surface of the bulge part are both d; a is an obtuse angle, and b is a reflex angle, so c is smaller than d (c<d).

7. A lighting fixture convenient to pack according to claim 6, which is characterized in that the lampshade also comprises an elongated plate and a first oblique side plate and a second oblique side plate located at the edges of two opposite sides of the elongated plate; the elongated plate is bent to form a second convex part located in the middle and with a channel, a first oblique piece and a second oblique piece located on two opposite sides of the second convex part; the first edging and the support on the first edging are formed at the side edge of the first oblique piece, while the second edging and the support on the second edging are formed at the side edge of the second oblique piece; the first convex piece and the third edging are formed on the first oblique side plate, while the second convex piece and the fourth edging are formed on the second oblique side plate; the first edging, the second edging, the third edging, and the fourth edging are connected end to end to form the frame; one port of the second convex part fits the first convex piece to close one end of the channel, and the other port of the second convex part fits the second convex piece to close the other end of the channel, thus forming the bulge part and the concave cavity in the bulge part; one end of the first oblique piece and one end of the second oblique piece fit the first oblique side plate, and the other end of the first oblique piece and the other end of the second oblique piece fit the second oblique side plate; the first oblique outer wall surface is formed on the outer wall of the first oblique piece, the second oblique outer wall surface is formed on the outer wall of the first oblique piece, and the third oblique outer wall surface is formed on the outer wall of the first oblique side plate, and the fourth oblique outer wall surface is formed on the outer wall of the second oblique side plate; the first oblique inner wall surface is formed on the inner wall of the first oblique piece, the second oblique inner wall surface is formed on the inner wall of the first oblique piece, the third oblique inner wall surface is formed on the inner wall of the first oblique side plate, and the fourth oblique inner wall surface is formed on the inner wall of the second oblique side plate.

8. A lighting fixture convenient to pack according to claim 7, which is characterized in that at least one of the inner walls of the first oblique side plate facing the first oblique piece, the inner wall of the first oblique side plate facing the second oblique piece, the inner wall of the second oblique side plate facing the first oblique piece, and the inner wall of the second oblique side plate facing the second oblique piece has a storage groove for the storage of cables.

9. A lighting fixture convenient to pack according to claim 8, which is characterized in that the lampshade also comprises an elongated plate and the first oblique side plate and the second oblique side plate located at the edges of two opposite sides of the elongated plate; the elongated plate is bent to form the second convex part located in the middle and with a channel, the first oblique piece and the second oblique piece located on two opposite sides of the second convex part; the first edging and the support on the first edging are formed at the side edge of the first oblique piece, while the second edging and the support on the second edging are formed at the side edge of the second oblique piece; the first convex piece and the third edging are formed on the first oblique side plate, while the second convex piece and the fourth edging are formed on the second oblique side plate; the first edging, the second edging, the third edging, and the fourth edging are connected end to end to form the frame; one port of the second convex part fits the first convex piece to close one end of the channel, and the other port of the second convex part fits the second convex piece to close the other end of the channel, thus forming the bulge part and the concave cavity in the bulge part; one end of the first oblique piece and one end of the second oblique piece fit the first oblique side plate, and the other end of the first oblique piece and the other end of the second oblique piece fit the second oblique side plate; the first oblique outer wall surface is formed on the outer wall of the first oblique piece, the second oblique outer wall surface is formed on the outer wall of the first oblique piece, and the third oblique outer wall surface is formed on the outer wall of the first oblique side plate, and the fourth oblique outer wall surface is formed on the outer wall of the second oblique side plate; the first oblique inner wall surface is formed on the inner wall of the first oblique piece, the second oblique inner wall surface is formed on the inner wall of the first oblique piece, the third oblique inner wall surface is formed on the inner wall of the first oblique side plate, and the fourth oblique inner wall surface is formed on the inner wall of the second oblique side plate.

10. A lighting fixture convenient to pack according to claim 9, which is characterized in that a plurality of locating pieces are respectively formed on the inner wall of the first oblique side plate facing the first oblique piece, the inner wall of the first oblique side plate facing the second oblique piece, the inner wall of the second oblique side plate facing the first oblique piece, the inner wall of the second oblique side plate facing the second oblique piece, the convex piece inner wall of the first oblique side plate, and the convex piece inner wall of the second oblique side plate; and the locating pieces fit the outer wall of the first oblique piece, the outer wall of the second oblique piece, and the horizontal outer wall surface.

11. A lighting fixture convenient to pack according to claim 1, which is characterized in that an included angle between the first oblique outer wall surface and the second oblique outer wall surface and a horizontal outer wall surface of the bulge part are both a, while the included angle between the third oblique outer wall surface and the fourth oblique outer wall surface and the horizontal outer wall surface of the bulge part are both b; a is an obtuse angle, and b is a reflex angle, so a is smaller than b (a<b);

the included angle between the first oblique inner wall surface and the second oblique inner wall surface and the horizontal inner wall surface of the bulge part are both c, while the included angle between the third oblique inner wall surface and the fourth oblique inner wall surface and the horizontal inner wall surface of the bulge part are both d; a is an obtuse angle, and b is a reflex angle, so c is smaller than d (c<d).

* * * * *